US007735543B2

(12) United States Patent
Farkas et al.

(10) Patent No.: US 7,735,543 B2
(45) Date of Patent: Jun. 15, 2010

(54) METHOD OF COMPACTING SUPPORT PARTICULATES

(75) Inventors: Attila P. Farkas, Milford, NH (US); Gary W. Scholl, Temple, NH (US); John A. Redemske, Milford, NH (US); David Bean, Allenstown, NH (US)

(73) Assignee: Metal Casting Technology, Inc., Milford, NH (US)

( * ) Notice: Subject to any disclaimer, the term of this patent is extended or adjusted under 35 U.S.C. 154(b) by 497 days.

(21) Appl. No.: 11/651,935

(22) Filed: Jan. 10, 2007

(65) Prior Publication Data

US 2008/0023170 A1 Jan. 31, 2008

Related U.S. Application Data

(60) Provisional application No. 60/833,178, filed on Jul. 25, 2006.

(51) Int. Cl.
*B22C 15/10* (2006.01)

(52) U.S. Cl. ..... 164/39; 164/203; 366/114

(58) Field of Classification Search ..... 164/37, 164/39, 40, 169, 203, 205, 260; 366/108, 366/114

See application file for complete search history.

(56) References Cited

U.S. PATENT DOCUMENTS

| | | | | |
|---|---|---|---|---|
| 3,581,805 | A * | 6/1971 | Hedberg | 164/192 |
| 4,085,790 | A | 4/1978 | Wittmoser | 164/7.1 |
| 4,612,968 | A | 9/1986 | Ashton et al. | 164/34 |
| 4,616,689 | A | 10/1986 | Denis | 164/34 |
| 4,736,787 | A | 4/1988 | McMellon | 164/154.1 |
| 4,787,434 | A | 11/1988 | Cleary et al. | 164/34 |
| 4,830,085 | A | 5/1989 | Cleary et al. | 164/255 |
| 4,844,142 | A | 7/1989 | Edge | 164/253 |
| 4,874,029 | A | 10/1989 | Chandley | 164/34 |
| 4,947,923 | A | 8/1990 | Rikker | 164/5 |
| 5,009,260 | A | 4/1991 | Cleary et al. | 164/255 |
| 5,069,271 | A | 12/1991 | Chandley et al. | 164/516 |
| 5,456,118 | A | 10/1995 | Hines et al. | 73/818 |
| 5,606,133 | A | 2/1997 | Hines et al. | 73/824 |
| 5,939,642 | A | 8/1999 | King et al. | 73/813 |
| 6,189,598 | B1 | 2/2001 | Chandley et al. | 164/34 |
| 6,453,976 | B1 * | 9/2002 | Chandley et al. | 164/34 |

(Continued)

FOREIGN PATENT DOCUMENTS

DE 10 2004 027 638 B3 2/2006

(Continued)

OTHER PUBLICATIONS

U.S. Appl. No. 60/833,178, filed Jul. 2006, Farkas et al.

*Primary Examiner*—Kevin P Kerns

(57) ABSTRACT

Method and apparatus for compacting support particulates media around ceramic shell molds and around fugitive patterns wherein the mold or pattern is placed in a container and the container is filled with support particulates media. The container is set to rotating and vibrating while it is tilted. The combination of rotation and tilting cause voids at the wall of the mold or pattern to be constantly and methodically reoriented so that the free surface of the support media in the voids is moved past its dynamic angle of repose and is caused to flow into those voids by the combined action of the vibration and the constantly changing orientation of the voids relative to the gravity vector.

31 Claims, 21 Drawing Sheets

U.S. PATENT DOCUMENTS

| | | | | |
|---|---|---|---|---|
| 6,457,510 | B1 | 10/2002 | van Heerveld | 164/39 |
| 6,575,614 | B2 | 6/2003 | Tosco et al. | 366/114 |

FOREIGN PATENT DOCUMENTS

| | | | |
|---|---|---|---|
| EP | 0 242 473 | | 10/1987 |
| JP | 07 001 076 | A1 | 1/1995 |
| JP | 11 179 487 | A1 | 7/1999 |
| JP | 2001 170 739 | A1 | 6/2001 |

* cited by examiner

METHOD OF COMPACTING SUPPORT PARTICULATES

This application claims benefits and priority of provisional application Ser. No. 60/833,178 filed Jul. 25, 2006.

FIELD OF THE INVENTION

The present invention relates to method and apparatus for compacting support particulates about a casting mold or fugitive pattern in a container.

BACKGROUND OF THE INVENTION

Metal casting methods are known wherein a ceramic shell mold is externally surrounded and supported by compacted support particulates, such as loose sand, in a container during casting. U.S. Pat. No. 5,069,271 and others describe such a casting method. Other casting methods are known wherein a foam pattern of the article to be cast is coated with a refractory coating and is externally surrounded and supported by compacted support particulates, such as sand, in a container during so-called lost foam casting. U.S. Pat. Nos. 4,085,790; 4,616,689; and 4,874,029 describe such a lost foam casting method.

Compaction of support particulates around the exterior of a ceramic shell mold or foam pattern in a casting flask (container) is a demanding process. First, support particulates such as loose sand must be fluidized and transported into deeply recessed voids about the exterior of the shell mold or foam pattern. To promote free flow, bridging of particulates must be eliminated. Next the particulates must be consolidated to provide structural support for the ceramic shell mold or foam pattern, which can be very fragile depending on shell mold wall thickness and surface characteristics of the refractory coated foam pattern. These two requirements are contradictory.

Simple vibration of the casting flask has been employed in the past to consolidate support particulates over all exterior sections of a mold or pattern. Vibration of the casting flask must be sufficiently rigorous to cause displacement and then consolidation of the support particles, but not so severe as to distort or damage the fragile mold or pattern; another contradictory demand.

To facilitate filling long, narrow channel-shaped voids at the exterior of the shell mold or refractory coated foam pattern, the shell mold or foam pattern has been oriented so that those channel-shaped voids are vertical or near vertical. When this is not possible, most compaction processes deal with the problem by controlling the fill rate of the casting flask. Since only the top fraction of an inch of a free surface of support particulates readily flows, this approach calls for filling the particulates media up to the level of the difficult-to-fill horizontal channel-shaped void and pausing the filling process until the fluidized particulates have a chance to travel to the end of the channel-shaped void. Filling of the casting flask is then resumed until the next hard-to-fill void is reached. Relying on this technique calls for precise vibration and particulates addition, recipes, and accurate fill level control.

Another problem with this approach is that for part of the compaction process the top of the shell mold or foam pattern is supported from above, while the bottom section is partially buried in the vibrating support particulate media and moves with the casting flask. The resulting flexing of the mold or pattern can cause mold or pattern distortion and mold wall cracking or pattern coating cracking.

An attempt to overcome the above problems is described in U.S. Pat. No. 6,457,510 and involves synchronizing four vibrators and altering their direction of rotation and eccentric phase angle relative to each other such that shaking of the casting flask can be altered to induce the support particulates to travel sideways. However, this process needs specific, vibration-vector altering recipes tailored to passage-shaped void geometry. Furthermore, controlled shaking is limited to one plane, perpendicular to the axes of the four vibrators. Finally, this patented compaction process, as well as all other compaction processes, are constantly fighting gravity when attempting to fluidize support media.

SUMMARY OF THE INVENTION

The present invention provides method and apparatus for compacting support particulates media about a casting mold or fugitive pattern in a container wherein a combination of systematic steps of container vibrating, container rotating, and container tilting relative to the gravity vector are used to vary mold or pattern orientation in a manner that the support particulates media are induced to fill simple and complex voids at a mold or pattern wall. Support particulates media are induced to flow into the voids where the particulates are trapped and consolidated by gravity and vibration vectors variable relative to the mold or pattern during the method.

One embodiment of the invention involves continuously vibrating, continuously rotating, and continuously tilting the container to vary mold or pattern orientation relative to the gravity vector. Another embodiment of the invention involves tilting the container in angular increments of inclination during compaction of the particulates media thereabout. The container can be subjected to rotation and vibration continuously, or intermittently at each of the angular increments of inclination. Still another embodiment of the invention involves subjecting the container to rotation and vibration while the container is tilted at a fixed angle of inclination relative to the gravity vector.

The present invention can be practiced to compact support particulates media about a gravity casting mold or pattern as well as a countergravity casting mold or pattern.

In an illustrative method embodiment of the invention, the mold or fugitive pattern is placed in a flask, and the flask is filled with support particulates media. The flask is set to continuously vibrating and rotating about a first axis while the container is continuously or fixedly tilted about a second axis relative to the gravity vector. The combination of container vibration, rotation, and tilting relative to the gravity vector causes channels, chambers, crevices, and other voids formed by the particular configuration of the mold or pattern wall to be repeatedly and methodically reoriented so that the free surface of the support particulates media in the voids is moved past its dynamic angle of repose and is caused to flow into those voids by the combined action of the vibration and the continuously changing orientation of the voids. Systematic repetition of such flask actions will eventually fill the voids formed by the mold or pattern wall with compacted support particulates media. When the orientation of the voids cycles during rotation such that openings of the voids are facing downward, the support particulates are prevented from exiting the voids by consolidated particulates media blocking the void opening. A lid optionally can be placed on the upwardly facing surface of the particulates media in the container to increase the angle to which the container can be tilted during practice of the compaction method.

In an illustrative apparatus embodiment of the invention, the container is disposed on a rotatable fixture and a first motor is provided for rotating the fixture to impart rotation to the container about a first axis thereof. The fixture, in turn, is disposed on a tiltable frame and a second motor is providing for tilting the frame to tilt the container about a second axis relative to the gravity vector. One or more vibrators are disposed on a table supporting the frame, on the frame itself, on the fixture itself, and/or on the container itself. A source of support particulates is provided to fill the container with the particulates after the mold or pattern is received in the container.

The compaction method and apparatus of the invention are advantageous in that they are minimally part-specific and need no complex particulates feeding recipe. Moreover, the compaction method and apparatus of the invention can be practiced to compact support particulates media about gravity casting molds or fugitive patterns as well as about counter-gravity casting molds or fugitive patterns.

These and other advantages will become more readily apparent from the following detailed description taken with the following drawings.

DESCRIPTION OF THE INVENTION

The present invention provides method and apparatus for compacting support particulates about a casting mold, such as a ceramic shell mold, or a fugitive pattern, such as a plastic pattern, in a container using a combination of container vibration, container rotation, and container tilting relative to the gravity vector to vary mold or pattern orientation in a manner that the support particulates are induced to fill simple and complex voids at a mold or pattern wall. The present invention can be practiced to compact support particulates in voids about any type of mold or fugitive pattern used in the casting of metals or alloys where support of the mold or pattern is desirable.

Figure 1:
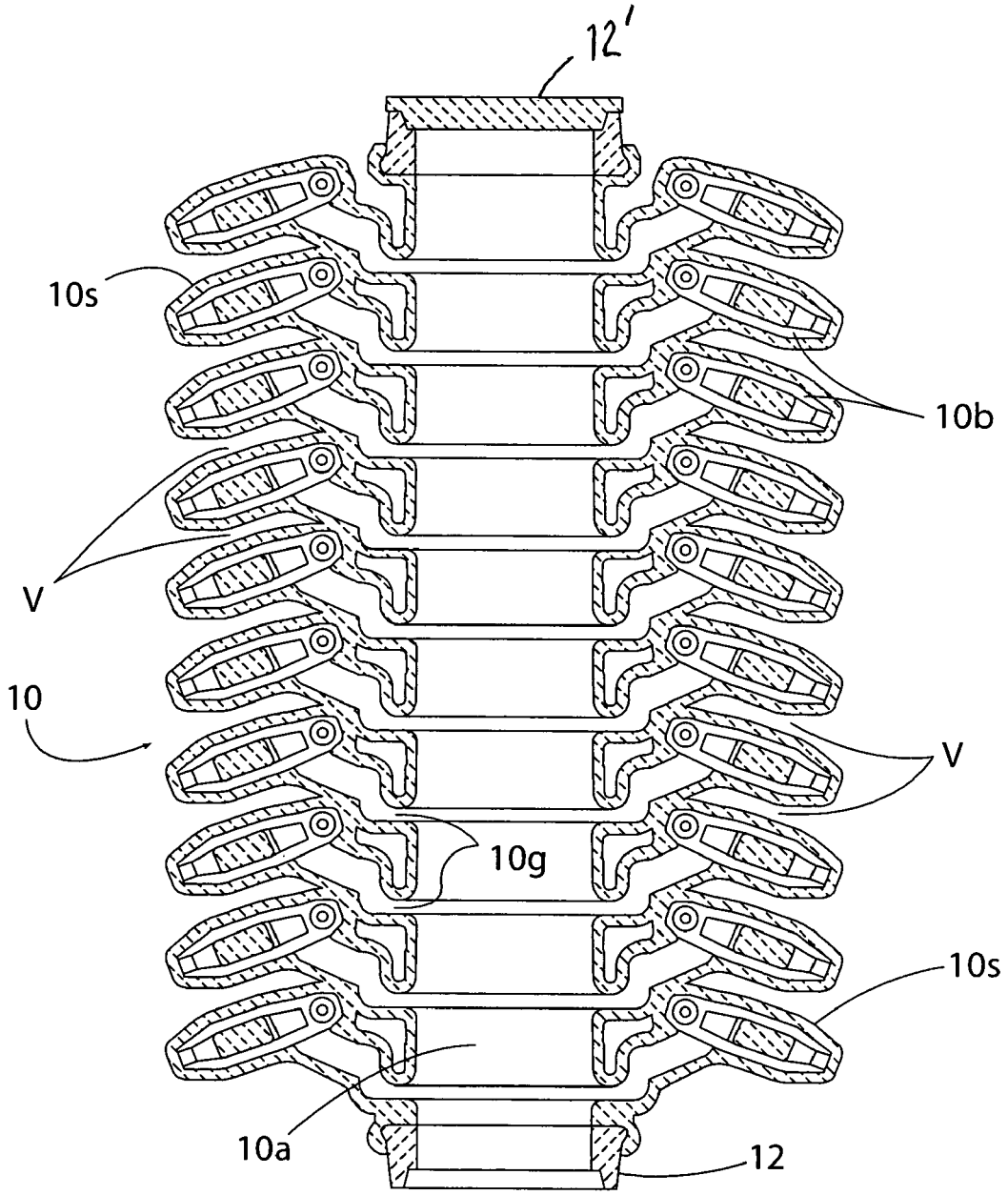
FIG. 1 is a longitudinal cross section of a ceramic shell mold having voids at an exterior mold wall.

Referring to FIG. 1 for purposes of illustration and not limitation, a thin wall ceramic shell mold 10 is shown having a central riser passage 10*a* and a plurality of mold cavities 10*b* that communicate via respective gate passages 10*g* with the riser passage to receive molten metal or alloy therefrom during countergravity casting as described in U.S. Pat. No. 5,069,271, the teachings of which are incorporated herein by reference. Such a ceramic shell mold 10 is typically formed by the well known lost wax process wherein a fugitive (e.g. wax or plastic) pattern assembly (not shown) is repeatedly dipped in ceramic slurry, drained of excess ceramic slurry, stuccoed with coarse ceramic stucco particles, and dried until a desired shell mold wall thickness is built up. The fugitive pattern then is selectively removed to leave a ceramic shell mold, which is fired to impart sufficient strength thereto for casting a molten metal or alloy therein. The shell mold 10 is provided with a ceramic collar 12 for communication with a fill tube (not shown) as described in the above patent for countergravity casting of a molten metal or alloy upwardly through the riser passage 10*a* and into the mold cavities 10*b* and a ceramic closure member 12'. The invention can be practiced with ceramic shell molds having any shell mold wall thickness where support of the shell mold wall during casting is desirable.

The invention is not limited to practice with ceramic shell molds of the type shown in FIG. 1 for countergravity casting of a metal or alloy and can be practiced with casting molds of any type and with gravity casting of metals or alloys. For purposes of illustration and not limitation, a ceramic shell mold supported by a support particulates media for gravity casting of a metal or alloy therein can be used in practice of the invention. Similarly, the invention can be practiced with a fugitive pattern such as, for purposes of illustration and not limitation, a plastic (e.g. polystyrene) foam pattern in a container wherein the pattern optionally may be coated with a thin refractory coating on the exterior surface of the pattern.

As is apparent in FIG. 1, the ceramic shell mold 10 includes an exterior configuration that forms a plurality of elongated channel-shaped or crevice-shaped voids V about the exterior surface or wall of the mold. The voids V are shown extending laterally (generally radially) relative to the riser passage 10*a*. For example, the voids V are formed between laterally extending mold sections 10*s* that define therein a respective mold cavity 10*b*. However, the voids V can have any shape and/or orientation relative to the riser passage depending upon the particular exterior configuration of the mold that is employed. FIG. 1 is provided simply to illustrative representative voids V which can be filled with compacted support particulates pursuant to the invention.

Figures 1A, 1B:
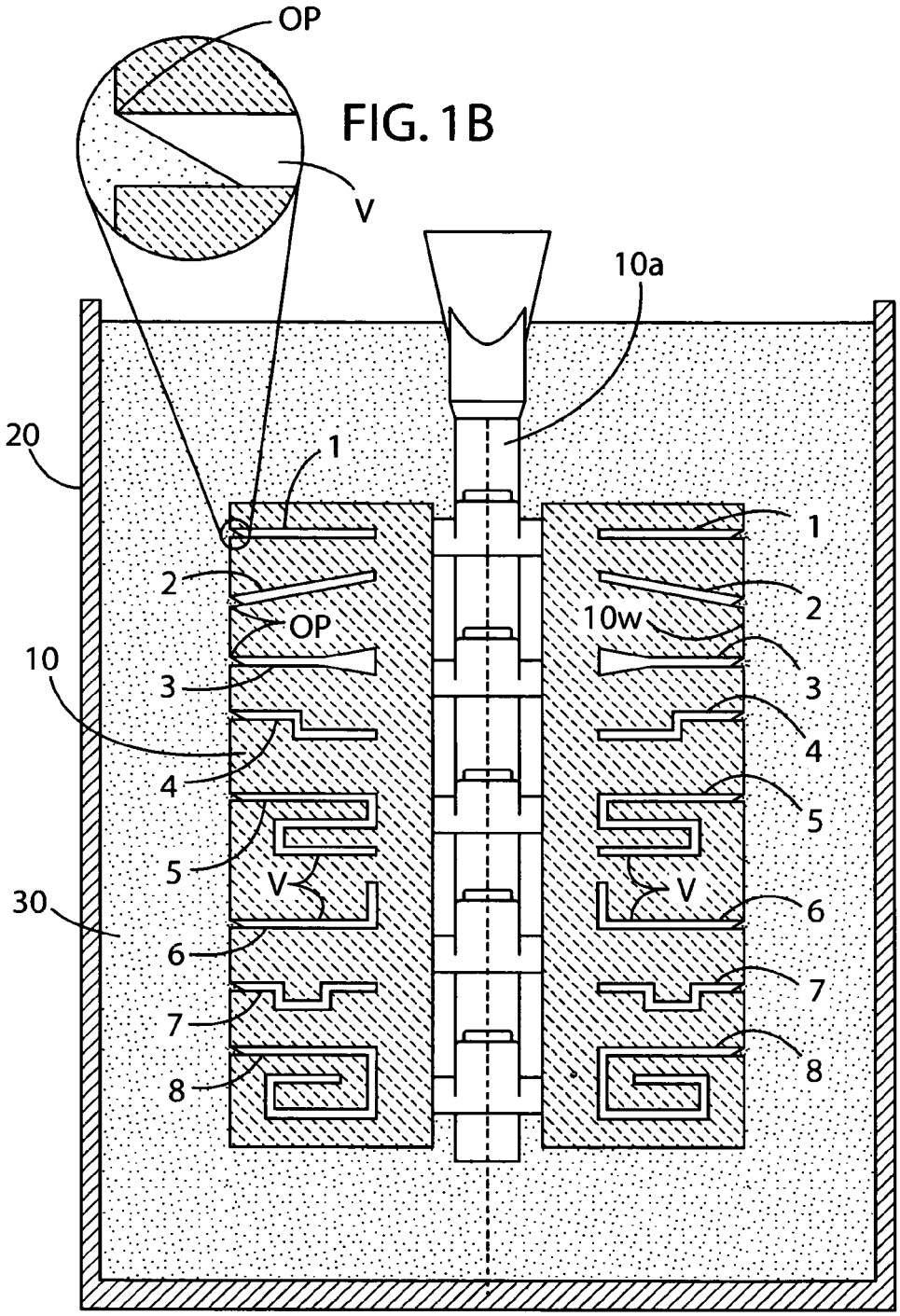
FIG. 1A is a cross section through a casting flask containing a hypothetical, cylindrical mold with intricate elongated channel-shaped annular voids in the outside mold wall radiating away from the riser toward the flask wall. The flask is filled with support particulates such as sand.
FIG. 1B is an enlarged view illustrating penetration of of the support media into a channel-shaped void as permitted by the static angle of repose of the support particulates.

FIG. 1A is provided to further show a casting flask (container) 20 containing a hypothetical, cylindrical casting mold 10 residing in support particulates media 30 wherein the mold 10 includes illustrative hypothetical intricate elongated channel-shaped annular voids V which are located at the outside mold wall 10*w* radiating away from the riser passage 10*a* toward the inner wall of the flask 20. The voids V are shown with varied configurations to illustrate different void shapes which can be filled with compacted support particulates (e.g. dry sand) by practice of the invention.

For example, consider the hypothetical, cylindrical mold 10 with a multitude of intricate voids V, such as those shown in cross-section in FIG. 1A. When the mold 10 is placed in the flask 20 and the flask is filled with a support particulates, a small amount of the particulates media 30, determined by its static angle of repose, will enter each void V as illustrated in FIG. 1B. Vibration of the flask 20 will fluidize the top inch or so of the particulates media 30 in the flask 20, but will not induce much more particulates media to flow into each void V.

Figure 2:
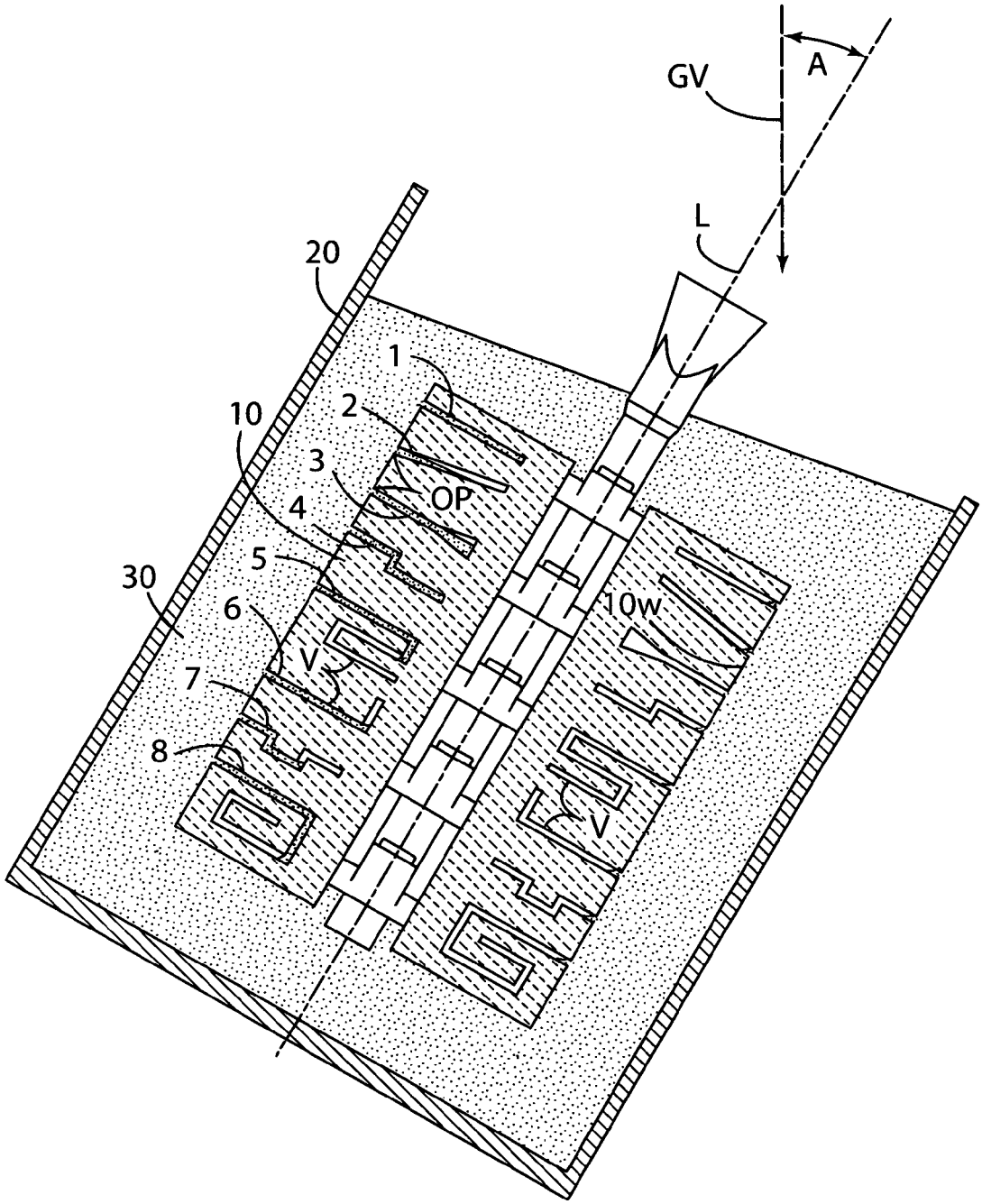
FIG. 2 shows the flask of FIG. 1 tilted to enhance particulates media flow into the channel-shaped voids wherein tilting is limited by the spilling of support particulates media over the rim of the flask. Channel-shaped voids designated 1 and 4 are completely filled. The remaining channel-shaped voids are only partially filled by the small inclination of the flask.

If the flask 20 is tilted at a fixed angle of inclination "A" relative to the gravity vector "GV" as shown in FIG. 2, the particulates media 30 will readily flow into those voids V which have upfacing openings OP and in general slope downwardly. Voids designated 1 and 4 in FIG. 1A will completely fill with loose (dry) particulates media; whereas voids 2 and 3 will fill only partially before the particulates media starts spilling over the edge of the flask. Vibration will enhance the flow of the particulates media into the voids and will increase consolidation of the particulates media in those voids. However, vibration will also cause more of the media to spill from the flask 20.

As the particulates media 30 flows into voids V and is compacted, media from above flows along the gravity vector to replace it. It is helpful to visualize the void as a "bubble". As the media trickles down, this "bubble" becomes rarified media and travels up, against the gravity vector until it encounters a surface impermeable to the media. When this occurs, the "bubble" will form a void under such surface. Depending on its shape and orientation such surface may capture the "bubble". For example, surfaces perpendicular to the gravity vector will capture the "bubble". Compaction in one area may be attained at the expense of losing compaction in another area. Practice of this invention permits such void "bubbles" to escape by systemically reorienting the capturing surfaces. When the "bubble" encounters the inclined flask wall, it will travel along the flask wall until it escapes through the upper, open surface of the particulates media 30.

Figure 3:
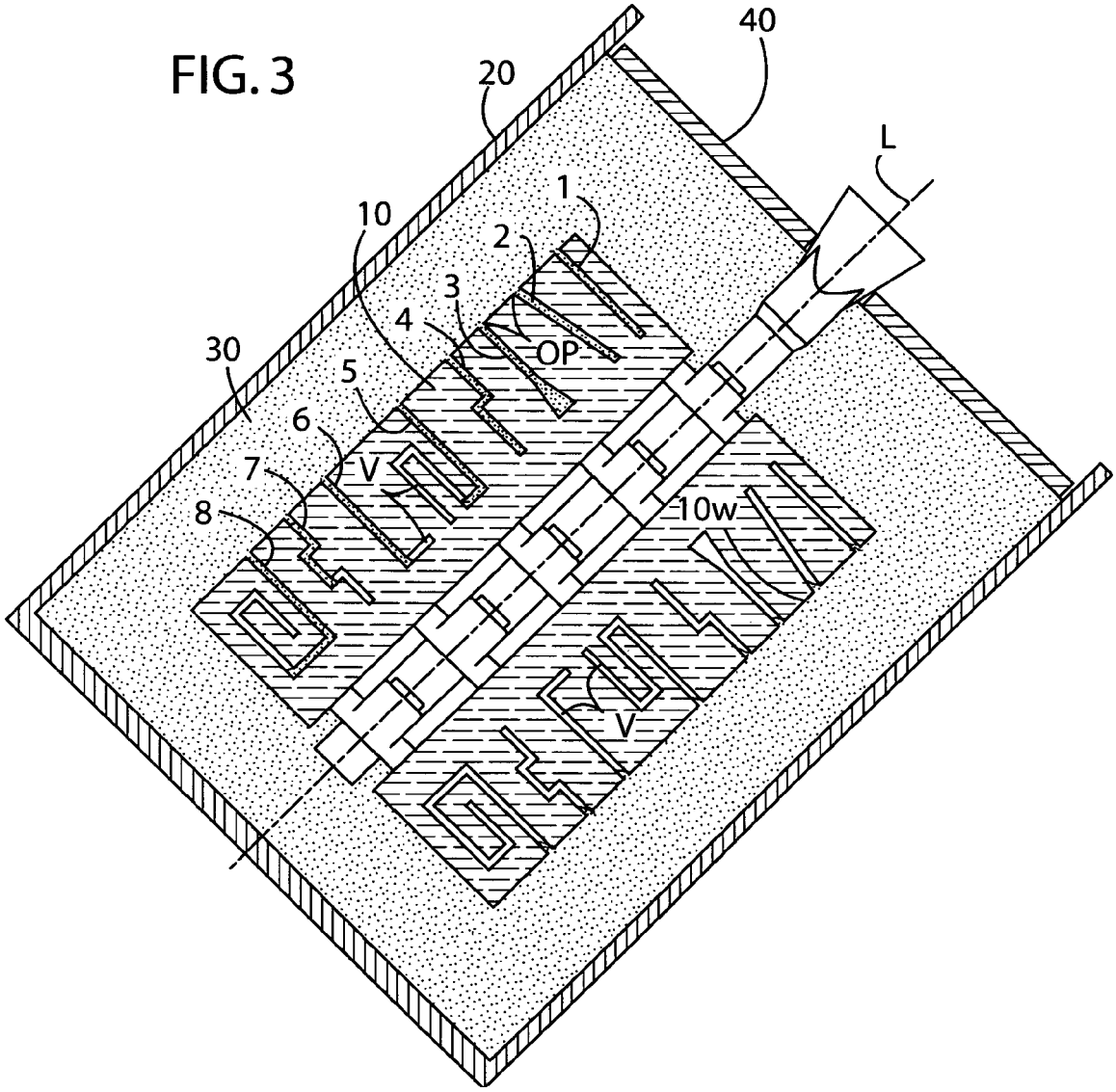
FIG. 3 shows the flask of FIG. 1 fitted with a floating lid made of a material denser than the bulk density of the media. The lid confines the particulates media by gravity and prevents media spillage at greater angle of inclination than possible without the lid. With sufficient vibration, the larger angle of inclination enables the filling of channel-shaped voids 1 through 4 and the consolidation the support grain in those voids.

If a loosely fitting lid 40, which is made from a material denser than the bulk density of the particulates media, is placed over the upper surface of the particulates media 30, FIG. 3, the flask 20 can be tilted to a much steeper angle without spilling of the particulates media over the edge of the flask. The force from the weight of lid 40 normal to the surface of the media is greater than the lifting force due to the wedge of particulates media 30 created by the angle of repose as illustrated in FIG. 7A. Because of this, the flask 20 can be tilted to 45-50 degrees without spillage of the particulates media 30. As shown in FIG. 3, at tilt angles made possible by the lid 40, more voids V are filled completely with the particulates media. Vibration of the flask 20 speeds the filling of the voids and compacts the particulates media once the voids are completely filled. As the particulates media fills the voids and compacts in the flask and voids, the resulting rarified media "bubbles" work their way to the upper surface of the particulates media under the lid 40 and escape along the rim of the lid. The upper surface of the particulates media 30 drops as a result, and the lid 40 settles deeper into the flask 20.

Figure 4:
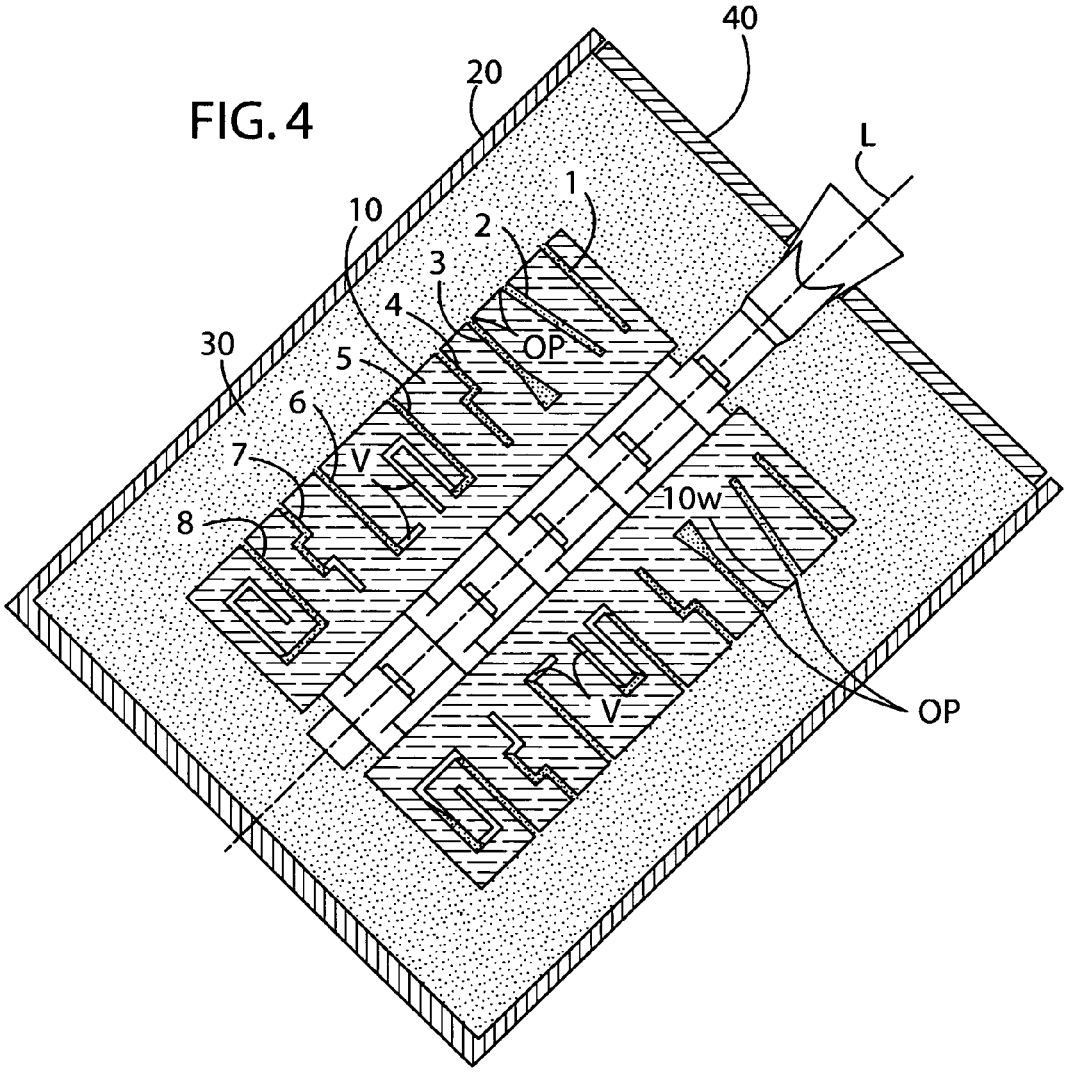
FIG. 4 shows the flask of FIG. 1 after it has been slowly rotated 180° about the longitudinal axis L of the flask. Channel-shaped voids 1 through 4 have been completely filled. The media has worked its way deeper into channel-shaped voids 5 and 8 with openings facing downward.

If the tilted flask 20 is slowly rotated about its longitudinal axis L, voids V radiating from the riser passage 10*a* of the mold 10 are moved to positions where their openings OP face upwardly as illustrated in FIG. 4. Therefore, each void will receive particulates media during part of the rotation cycle of the flask. FIG. 4 shows the mold after one half revolution. Voids that face down do not lose particulates media because compacted particulates media outside the voids blocks their openings OP. If the rotational speed is sufficiently slow, voids designated 1 through 4 will fill in one revolution. However, with respect to voids 5 and 8, during the portion of the cycle when the openings OP to these voids face downwardly, particulates media will move deeper into the voids, leaving a temporary gap in the particulates media column in those voids. After several rotations of the flask, the zigzagging void 5 is completely filled with compacted particulates media as illustrated in FIGS. 5 and 10L.

As the rarified media "bubble" rises straight up along the gravity vector, its path through the media is distorted by rotation, tracing a spiral toward the flask inner wall. If the "bubble" encounters any obstruction impermeable to the media, it will accumulate under such obstruction. If the obstruction is a mold surface, it will face up during part of the flask rotation cycle, releasing the "bubble". Eventually the rarified media "bubble" will encounter the flask inner wall and due to the inclined flask rotation, will spiral upward along the flask inner wall until it escapes through the exposed upper surface of the particulates media as discussed above.

This particulate media and rarified media "bubble" movement process will completely fill any void V, regardless of its complexity, as long as all segments of the void slope downward during at least a portion of the rotation cycle of the flask 20. The slope must be greater than the angle of repose of the particulates media for a given vibration imparted to the flask 20. This angle hereafter is referred to as the dynamic angle of repose of the particulates media and is much less than the static angle of repose.

Figure 5:
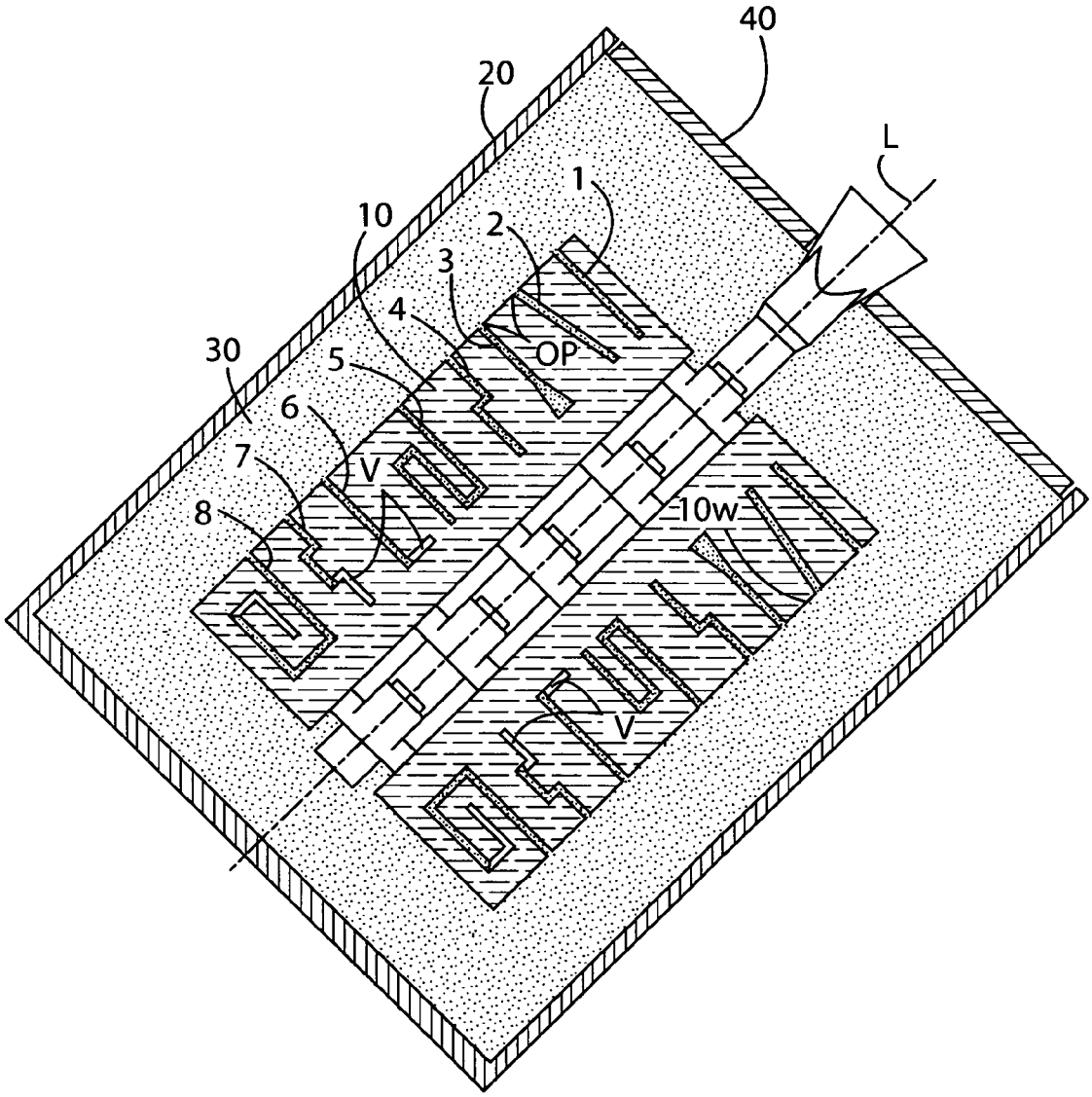
FIG. 5 shows the same flask after several rotational cycles about axis L. Channel-shaped voids 1 through 5 have been completely filled with compacted media. The remaining channels will not fill further at this angle of inclination no matter how long the compaction process is continued.

In FIG. 5, voids 6, 7 and 8 cannot be completely filled under the flask vibration, rotation and tilt conditions discussed so far. This is so because the end of void 6 slopes up during the entire rotation cycle of the flask and the last two segments of voids 7 and 8 are blocked by the always upward sloping fourth segment. These voids 6, 7, and 8 can be filled by another embodiment of the invention discussed below.

Although the voids V in FIGS. 1 through 5 are shown residing in a plane containing the flask longitudinal (rotational) axis L, the voids can be oriented in any direction and filled with particulates media 30 so long as the voids slope downwardly during a portion of the rotation cycle of the flask 20. Further, if voids 6 through 8 in FIGS. 1 through 5 were oriented in a "plane perpendicular to the flask longitudinal (rotational) axis", (a plane parallel to the container bottom), they could be readily filled with compacted particulates media by vibration and rotation of the tilted container as described above.

Figure 9:
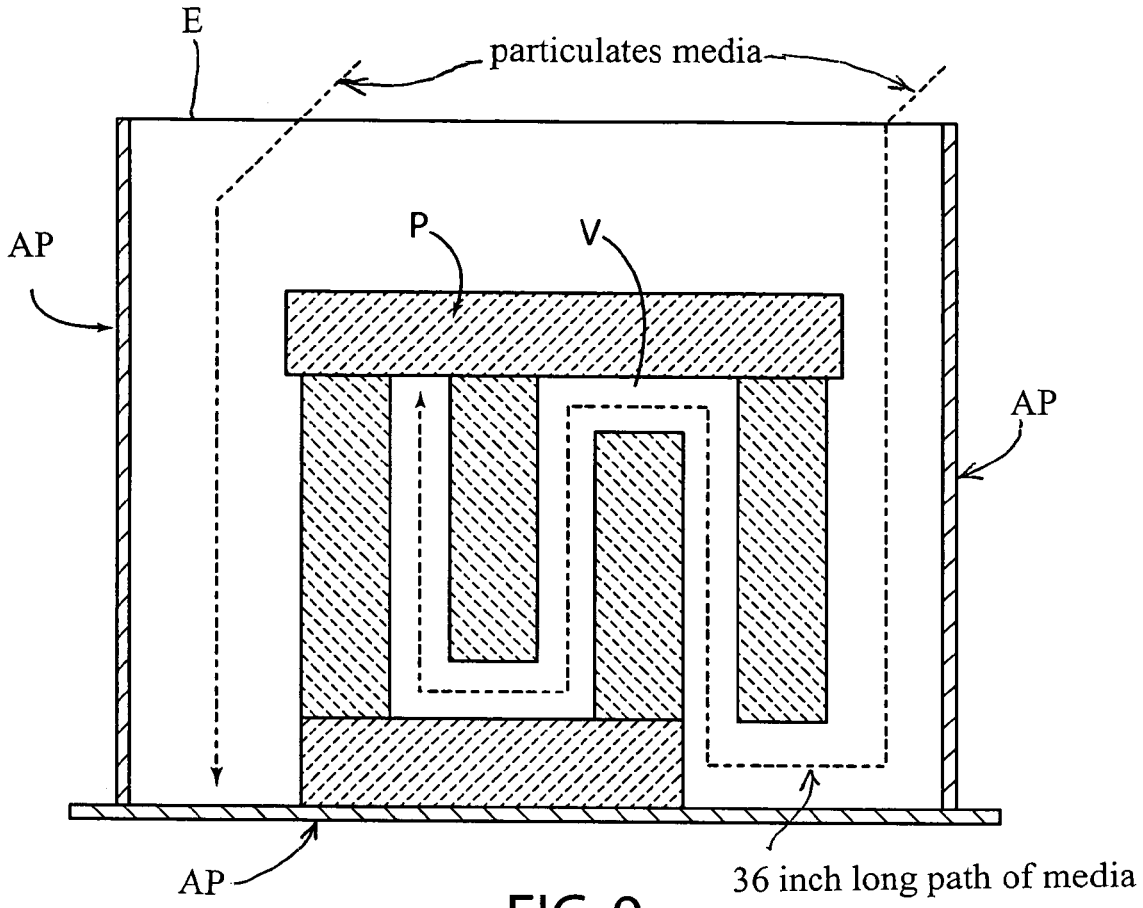
FIG. 9 is an elevational view of a compaction test cell with an intricate channel-shaped void, similar to void 5 in FIGS. 1 through 5, that was completely filled with compacted sand by practice of the invention.

FIG. 9 is an elevational view of a compaction test cell (simulating a section of a mold or pattern P) with an intricate channel-shaped void V, similar to void 5 in FIGS. 1 through 5, that was completely filled with compacted sand by practice of the invention. In particular, the compaction test cell was constructed of polystyrene bars sandwiched between vertical, transparent acrylic plates AP. The compaction test cell formed a channel-shaped void having dimensions of 1½ inches by 1½ inches by 36 inches long, similar in shape to void 5 in FIGS. 1 through 5. In the vertical orientation shown, the compaction test cell was placed on the bottom of a 30-inch deep cylindrical flask, and the flask was filled with dry CALIMO 22 support media in 32 seconds. The flask was not vibrated during the filling sequence. Next, the flask was tilted to a fixed angle of inclination of 30° relative to the gravity vector (vertical), vibrated with less than 1 G and rotated at 6 rpm for two minutes on a centrifugal casting machine having capability to tilt, rotate, and weakly vibrate for initial testing purposes.

This combination of flask vibration and rotation while the flask was tilted at a fixed angle of inclination for two minutes completely filled the torturous channel-shaped void of the test cell with compacted foundry sand.

In contrast, a comparison test using the same casting machine, the same test cell and same support media, was conducted where only the above-described flask vibration condition was employed. That is, the flask was not tilted to the fixed 30° angle of inclination and was not rotated. The comparison test resulted in only partially filling the channel-shaped void above the top polystyrene bar with loose media. That is, the remaining portion, more than 90%, of the channel-shaped void remained empty and not filled with support media.

Figure 10A:
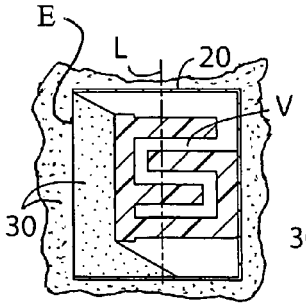
FIGS. 10A through 10L are schematic views of the test cell showing a theoretical compaction sequence.
Figure 10B:
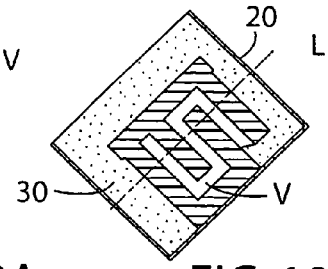
Figure 10C:
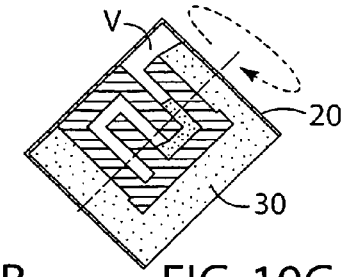
Figure 10D:
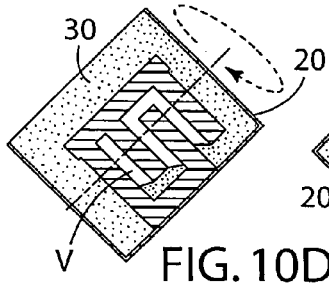
Figure 10E:
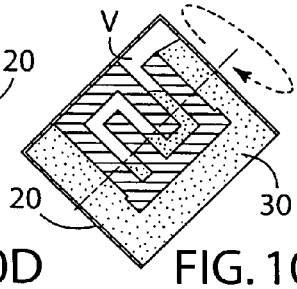
Figure 10F:
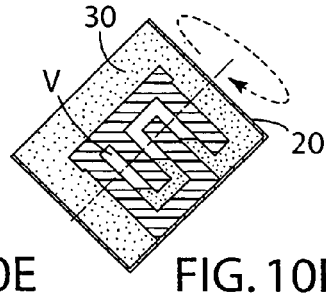
Figure 10G:
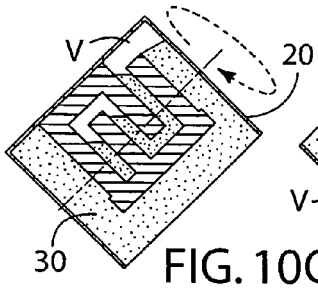
Figure 10H:
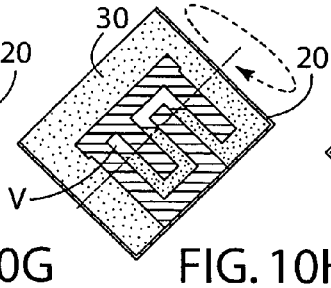
Figure 10I:
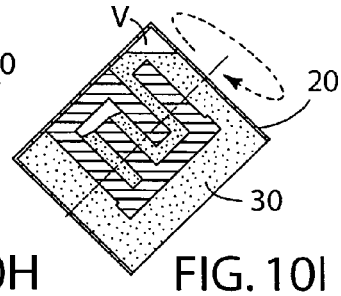
Figure 10J:
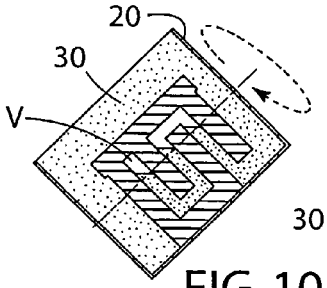
Figure 10K:
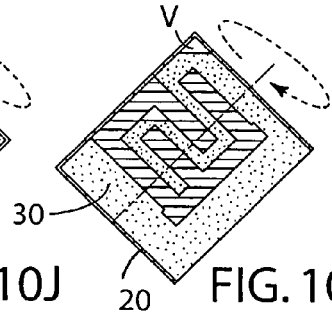
Figure 10L:
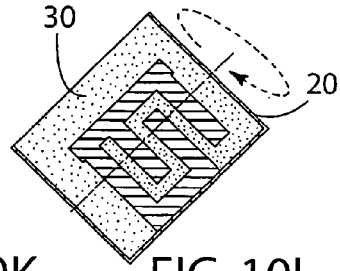

FIGS. 10A through 10L illustrate a filling sequence that occurs to fill and compact the foundry sand in the tortuous channel-shaped void V, FIG. 9, of the test cell. This sequence is offered merely for purposes of illustration and not limitation of the invention. Referring to FIG. 10A, the test cell is initially positioned on its side in the vertically oriented flask (not shown) with open end E of the test cell facing to the left in FIG. 10A. The flask is oriented vertically with its open end facing upwardly (e.g. see FIG. 1A). Foundry sand 30 is then introduced into the flask until it is filled so as to dispose the test cell in the foundry sand, where only a portion of the foundry sand around the test cell in the flask is shown in FIG. 10A for convenience. In FIGS. 10B-10L, the foundry sand 30 around the test cell is omitted for convenience. FIG. 10A shows sand penetration only to the static angle of repose after filling of the vertical flask. FIG. 10B shows the extent of particulates media (sand) penetration into the voids after the filled flask is tilted to the 30° angle of inclination and the systematic rotation has brought the open end E of the test cell to a partially upward facing position, wherein initial orientation of the test cell about the axis of rotation is not important. In FIG. 10C, the tilted flask is rotated 180 degrees further about its longitudinal axis at 6 rpm while being vibrated at less 1 G with the slug of particulates media being shown to have flowed deeper into the channel. In FIGS. 10D through 10K, vibration and rotation of the tilted flask is continued, and the particulates media continues to flow sequentially into the void until the void is filled with compacted foundry sand as shown in FIG. 10L. Note in these figures how the void "bubble" is fractionated by the intruding media and how the "bubble" segments work their way out of the channel in counter flow with the media. Actual filling and compaction of the void took 12 complete revolutions of the flask.

As mentioned above, the invention can be practiced to compact support particulates media about a casting mold or fugitive pattern for use in gravity or countergravity casting processes.

Gravity Casting Embodiment

Figure 7B:
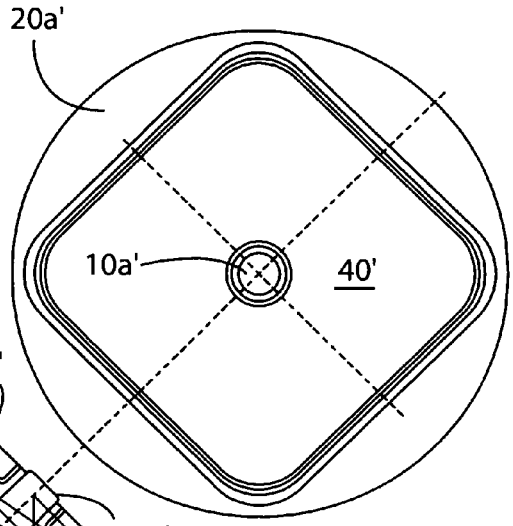
FIG. 7B is a plan view of the casting flask of FIG. 7A.
Figure 7A:
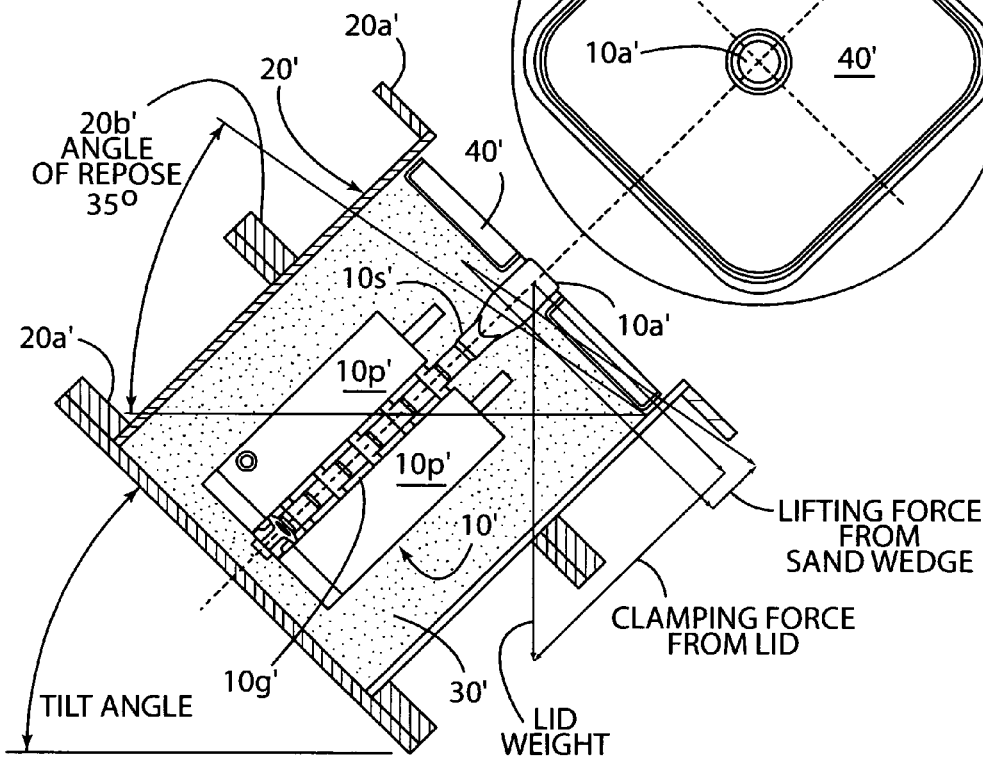
FIG. 7A is a longitudinal cross-section of a square cross-section, lost foam casting flask fitted with circular flanges and circular reinforcing rib. The flask contains a lost foam pattern corresponding to a pair of engine cylinder heads attached to a riser. The flask is filled with support media. Before the flask was tilted, a square-shaped lid, with an opening for the pour cup, is shown placed on the surface of the media. The force vector, along the axis of the flask, from the weight of the lid is shown being larger than opposing vector from the wedge of media above its angle of repose.

FIGS. 7A, 7B illustrate a flask 20' for use with a gravity casting lost foam pattern 10' disposed in the flask with the flask filled with the support particulates media 30'. For purposes of illustration and not limitation, the flask or container 20' can be made of steel or any other appropriate material and can have any shape such as, for example, a cylindrical flask or a flask with a square or other polygonal cross-section.

The fugitive pattern 10' comprises a pour cup 10*a*', a riser 10*s*', and a pair of engine cylinder head patterns 10*p*' connected to the riser 10*s*' by gating 10*g*'. The pattern 10' can be made of polystyrene that is coated with a thin layer (e.g. ½ mm) of refractory, usually, but not limited to, a mica or silica base material.

Figures 8A, 8B:
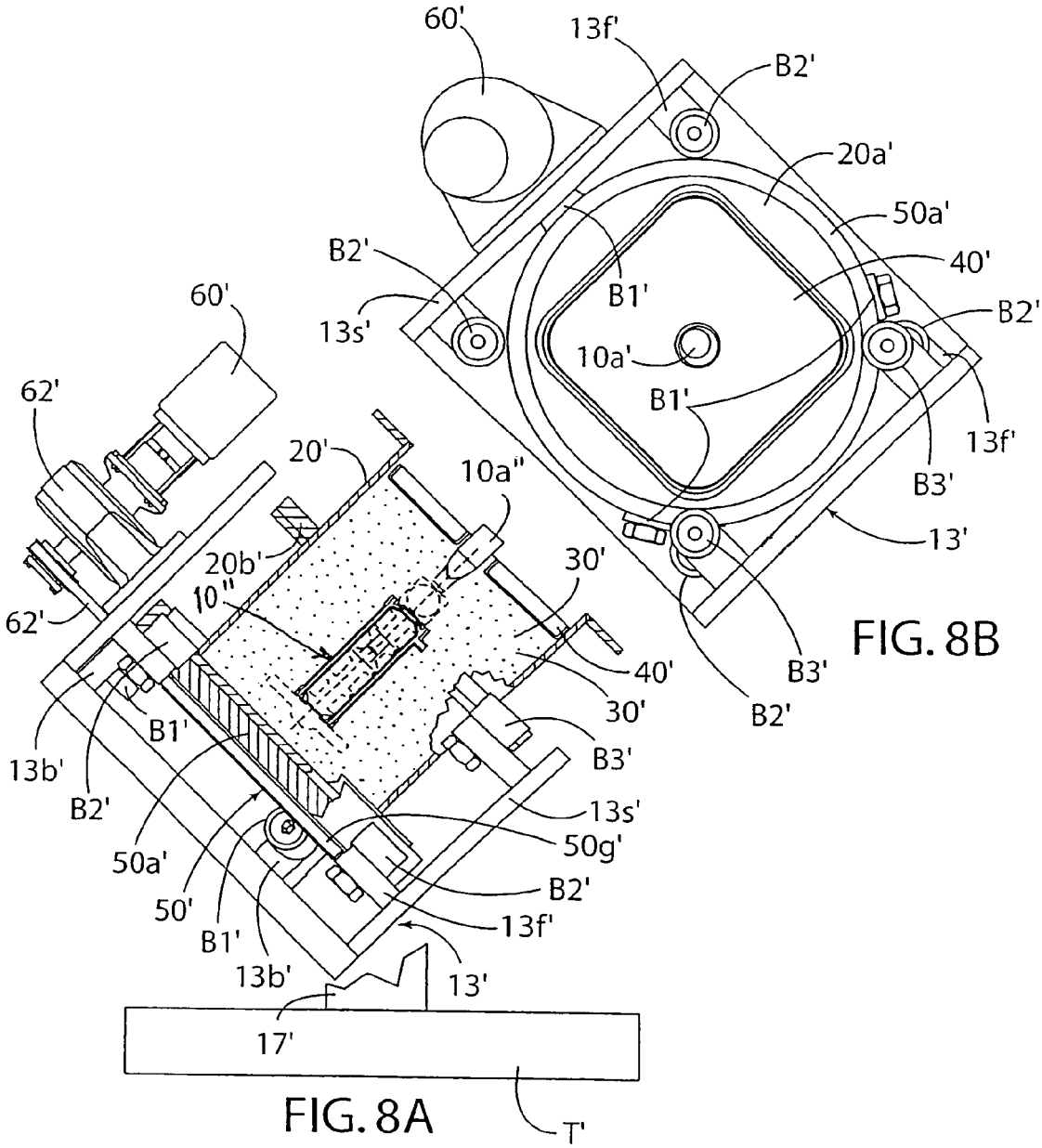
FIG. 8A is an elevational view, partially in section, of compaction apparatus for rotating a casting flask with the engine block pattern of FIG. 6 while is being tilted between selected inclination angles.
FIG. 8B is a plan view of the apparatus of FIG. 8A.

The flask 20' includes circular flanges 20*a*' and circular intermediate reinforcing rib 20*b*' for for ease of rolling in the compaction apparatus of FIGS. 8A, 8B.

Figure 6:
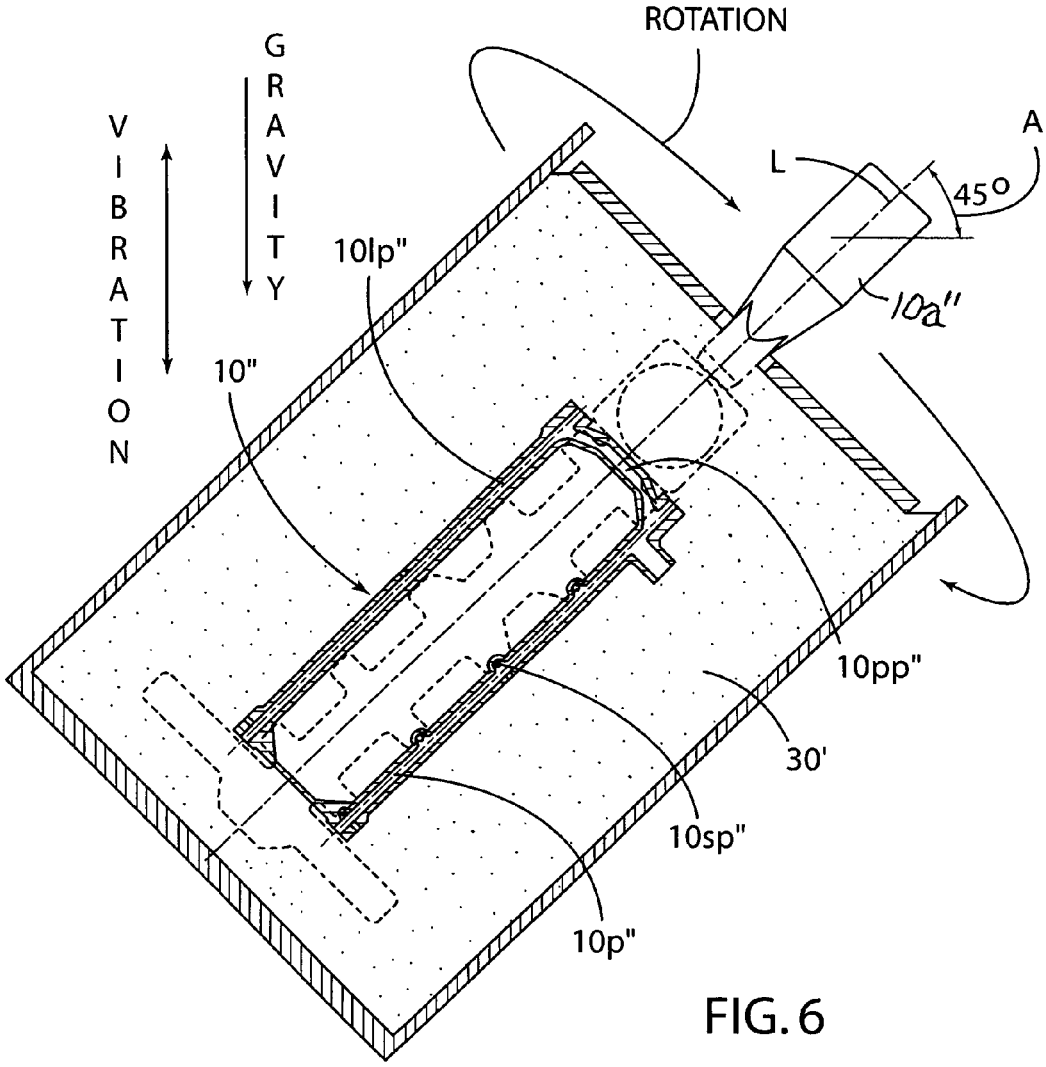
FIG. 6 is a cross-sectional view through a casting flask having a lost foam pattern of an engine block residing in support particulates media. The engine block pattern is shown having internal oil channel-forming passages that communicate to an exterior surface of the pattern. The pattern is shown being tilted to 45°.

FIGS. 8A, 8B illustrate apparatus for compacting the particulates media 30' about lost foam engine block pattern 10" shown in more detail in FIG. 6 disposed in the particulates media 30' in the flask 20'. For purposes of illustration and not limitation, the support particulates media 30' can comprise dry foundry sand or any free-flowing refractory particulates, which typically are unbonded particulates devoid of resin or other binder as described in U.S. Pat. No. 5,069,271. However, the support particulates optionally may be bonded to a limited extent that does not adversely affect the capability of the support particulates to be fluidized and compacted about the mold or pattern in the flask 20' pursuant to the invention.

Referring to FIG. 8A, the apparatus includes a conventional vibrating compaction table (base) T' (shown schematically). Alternately or in addition separate vibrators can be employed in a manner shown in FIGS. 11A; 12A, 12B; 14, 16 and 18. Tilting of the flask 20' to a selected angle of inclination relative to the gravity vector is achieved by any of the trunnion (tilting) mechanisms shown in FIGS. 11A, 11B, 11C; 12A, 12B; 13; 14; 16; and 18 diposed on the vibrating table T and described herebelow. For purposes of illustration and not limitation, trunnion support stanchions 17' are provided on the table T' to support a tiltable frame 13' on which a rotatable nest (fixture) 50' is disposed for receiving the flask 20'.

The flask 20' is placed into the nest 50' prior to tilting of the nest 50' on frame 13'. The nest 50' comprises a base plate 50*a'* on which the flask 20' is disposed. The nest base plate 50*a'* includes a cylindrical recess to receive the bottom of the flask 20'. Nest base plate 50*a'* rests on three crowned roller bearings B1' spaced 120 degrees apart on support posts 13*b'* on the frame 13' and is centered by four more roller bearings B2' on support flanges 13*f'* engaging about the circular base plate 50*a'* of the flask. A gear motor 60' rotates the nest 50' by means of a drive belt 62' engaging belt-receiving groove 50*g'* on the base plate 50*a'*.

While the flask 20' is vertically oriented in the nest 50', the pattern 10" is placed into the flask, and the flask is filled with support particulates media 30', such as dry foundry sand, from any suitable particulates source, such as an overhead hopper (not shown). Before the flask is tilted, a square-shaped, loosely-fitting, free-floating lid 40' with an opening for the pour cup 10*a"* is shown placed on the upper surface of the particulates media to prevent it from spilling when the tilt angle exceeds the angle of repose of the particulates media. The pour cup 10*a"* extends through the lid opening so to be exposed to receive molten metal or alloy to be cast, FIG. 8B, in gravity manner from a crucible or other melt-holding vessel (not shown). The force vector, along the axis of the flask from the weight of the lid 40' is shown in FIG. 8A being larger than opposing vector from the wedge of particulates media 30' above its static angle of repose. This keeps the top surface of the particulates media square with the sides of the flask when the flask is tilted up to 50 degrees. As the media is consolidated, the lid settles deeper into the flask. When the flask is returned to an upright position, the top surface of the media is horizontal.

Vibration of the table T' and rotation of the flask 20' can be started while the flask 20' is still vertically oriented in the nest 50', although the invention is not limited to this sequence. The nest 50' then is tilted to a fixed angle of inclination relative to the gravity vector as shown in FIG. 8A on the trunnion support stanchions 17' (only one shown). The tilted flask 20' is rotatably supported in the inclined position by two more roller bearings B3' disposed on upstanding side plates 13*s'* of frame 13' in a manner to engage the circular intermediate rib 20*b'* of the flask as shown in FIG. 8B. Vibration and rotation of the flask while it is tilted are continued until the voids on the pattern 10", especially on engine block patterns, are filled with compacted foundry sand.

For further illustration, FIG. 6 shows lost foam engine block pattern 10" that includes internal oil passages 10*p"*. In FIG. 6, a flask having the engine block pattern is subjected to vibration parallel to gravity as shown, although vibration in any direction can be used in practice of the invention, and rotation while the flask is tilted as shown. As the flask rotates, the longest oil channels 101*p"* remain inclined at 45°. Oil channels 10*pp"* perpendicular to the longest oil passages, vary between −45° and +45° inclination in a sinusoidal manner due to the rotation. Other short oil channels 10*sp"* extend in and out of the plane of the drawing shown. These oil channels or passageways 10*sp"* are also varied between −45° and +45° inclination by the rotation. During compaction tests, the engine block pattern 10" actually was orbited offset several inches from the axis of rotation (longitudinal axis) L of the flask. Since one complete rotation occurs during each orbit of the pattern, the effect on filling and compaction of foundry sand in the oil channels of the pattern 10" is the same.

The apparatus of FIGS. 7A, 7B; 8A, 8B can be used with any mold or pattern that needs compacted particulates media support during gravity casting. For the gravity casting embodiment of the invention illustrated in FIGS. 7A, 7B; 8A, 8B, the method of inclined rotary compaction pursuant to the invention involves:

Casting flask 20' is secured to variable-tilt, rotatable nest or fixture 50' on top of a conventional compaction table T'. A mold or pattern 10' is loaded into the flask by hand typically without vibration of the flask. For example, a small amount of foundry sand is placed in the flask and the pattern is gently pressed into the foundry sand. In production, the pattern would be supported in the flask by a fixture (not shown) at the beginning of the flask fill cycle, which fixture would release the pattern at a later time. The vertical flask is filled with support particulates media, such as foundry sand, by any conventional means. To slightly shorten the compaction process, the flask 20' may be vibrated during the filling operation, but it is not necessary to do so at this time. (If vibration is not induced during the filling process, vibration isolators are not needed on the mold-loading fixture.) When sufficient particulates media has been introduced to maintain mold or pattern orientation, the mold or pattern is released and the remainder of the flask is filled.

If the flask is going to be tilted past the angle where the particulates media would spill, loosely fitting cover 40' is placed on the upper surface of the particulates media 30' at this time. The cover has an opening for the pour cup 10*a'* of the pattern.

Vibration of compaction table T' is started simultaneously with rotation of the flask about its vertical longitudinal axis L, and the flask 20' is tilted to the compaction angle of inclination with respect to the gravity vector. For most molds or patterns 10' having a multitude of voids, a 30-35° tilt angle is sufficient and lid 40' is not needed.

The flask 20' can be tilted to a fixed angle of inclination "A" where the flask is vibrated and rotated either continuously or intermittently.

Alternately, the flask 20' can be tilted continuously from the vertical position to the 30-35° angle of inclination "A" and then back to the vertical position, if desired, in back and forth manner, while the flask is vibrated and rotated either continuously or intermittently.

Still further, the flask 20' can be tilted in increments between the vertical position and the 30-35° angle of inclination "A", such as for purposes of illustration and not limitation, from vertical orientation to a 10° angle for a period of time, to a 20° angle for a period of time, and then to a 30° angle for a period of time while the container is vibrated and rotated, which can occur continuously or intermittently during the time the container resides at each of the angular positions (e.g. 10°, 20°, etc.). The sequence then can be reversed from the 30° angle for a period of time to the 20° angle for a period of time, and then to the 10° angle for a period of time with container vibration and container rotation occurring continuously or intermittently during the time the container resides at each of the angular positions (e.g. 10°, 20°, etc.).

In practicing the inclined rotary compaction method embodiment of the invention where the flask is continuously tilted during compaction, it is preferred to have the rotational cycle frequency of the flask be an even multiple of the tilting cycle frequency of the flask. For purposes of illustration and not limitation, if the flask is rotated at a steady 2 rpm, then the flask is smoothly and continuously cycled through a tilt angle from 0° (vertical) to the angle of inclination and then back to 0° position in one minute. This cycle is repeated until full compaction is achieved. Such parameters will result in equal opportunity for all voids at the mold or pattern, symmetrically oriented about the rotational axis, to be filled regardless of orientation.

For any support particulates media being compacted with a combination of rotational speed, vibration frequency and vibration amplitude, a tilt angle can be found where the downward flow of the particulates media 30' at the upper surface thereof is exactly matched by the rate of rotation of the upper surface of the particulates media. As long as this tilt angle is not exceeded, the upper surface of the particulates media 30' stays parallel to the rim of the flask 20' and will be level when the flask 20' is returned to vertical. For lost foam patterns with long, intricate internal passages, such as oil channels in engine blocks, a 45° tilt angle is the best, see FIGS. 6-8. A floating lid 40' may be required to prevent the sand from spilling.

Flask rotational speed of between ½ to 2 rpm is preferred for most molds or patterns. Slow rotational speeds orient horizontal and near horizontal voids V so they are inclined past the dynamic angle of repose of the particulates media for several seconds during each rotation. This allows ample time for the voids to fill. Very slow rotational speed will mandate longer compaction cycles for intricate zigzagging voids such as void 5 in FIGS. 1-5 because several rotations are needed to fill such voids.

High rotational speed changes void orientation before media flow to the void is established. At sufficiently high speed and radius of gyration, centrifugal effects come into play, causing rotation to become detrimental. For example, if the flask is rotated at 60 rpm, a void V inclined at 30° relative to container axis L with an opening 5 inches or more from the axis of rotation of the flask, the component of the gravity vector acting along the void will be neutralized by the centrifugal acceleration, and particulates media flow into the void will be blocked.

At slow rotational speeds, slower than 10 rpm, the centrifugal effect is negligible and can be ignored. As described earlier, because of the tilt angle (angle of inclination) of the flask, horizontal voids that rotate to partially face upwardly readily fill under the combined influence of gravity and vibration. As the flask rotates, filled voids partially face downwardly during half of the rotational cycle. However, they will not empty because their openings are now blocked by compacted particulates media blocking the openings. The compacted particulates media around the mold or pattern prevents the mold or pattern from shifting in the flask; therefore the mold or pattern need not be supported during the compaction cycle.

Because the mold or pattern is not attached to a non-vibrating element, such as mold-loading fixture, but is free to float, mold or pattern distortion is minimized.

Deep or contorted voids or large-volume voids with small openings OP may not completely fill during one rotation cycle. This, however, is not a problem. As the free surface in such void rotates past the dynamic angle of repose, particulates media flow is reestablished. Compacted media that has now rotated above the void, thus left, will fluidize and flow down into the void again. (see FIG. 10.) Conventional particulates compaction techniques will not do this.

Bridging of the particulates media granules or particles will randomly occur. If bridging occurs near the opening (e.g. opening OP—FIG. 1A) of a narrow internal void, or in the void, particulates media flow to the void may be temporarily blocked by a dome-like secondary void formed in-situ at the opening or in the void. However, flask rotation will turn such a secondary dome-like void on its side, causing the dome-like void to collapse; reestablishing media flow to the void. Once a void is completely filled, gravity and vibration will consolidate the particulates media in the void while the void is sloped past the dynamic angle of repose of the particulate media. Once there are no free surfaces left in voids, no more particulates media fluidization will occur, except on the top, free surface.

The compaction cycle is completed by returning the flask to the vertical orientation and stopping the rotation and the vibration.

Figure 13:
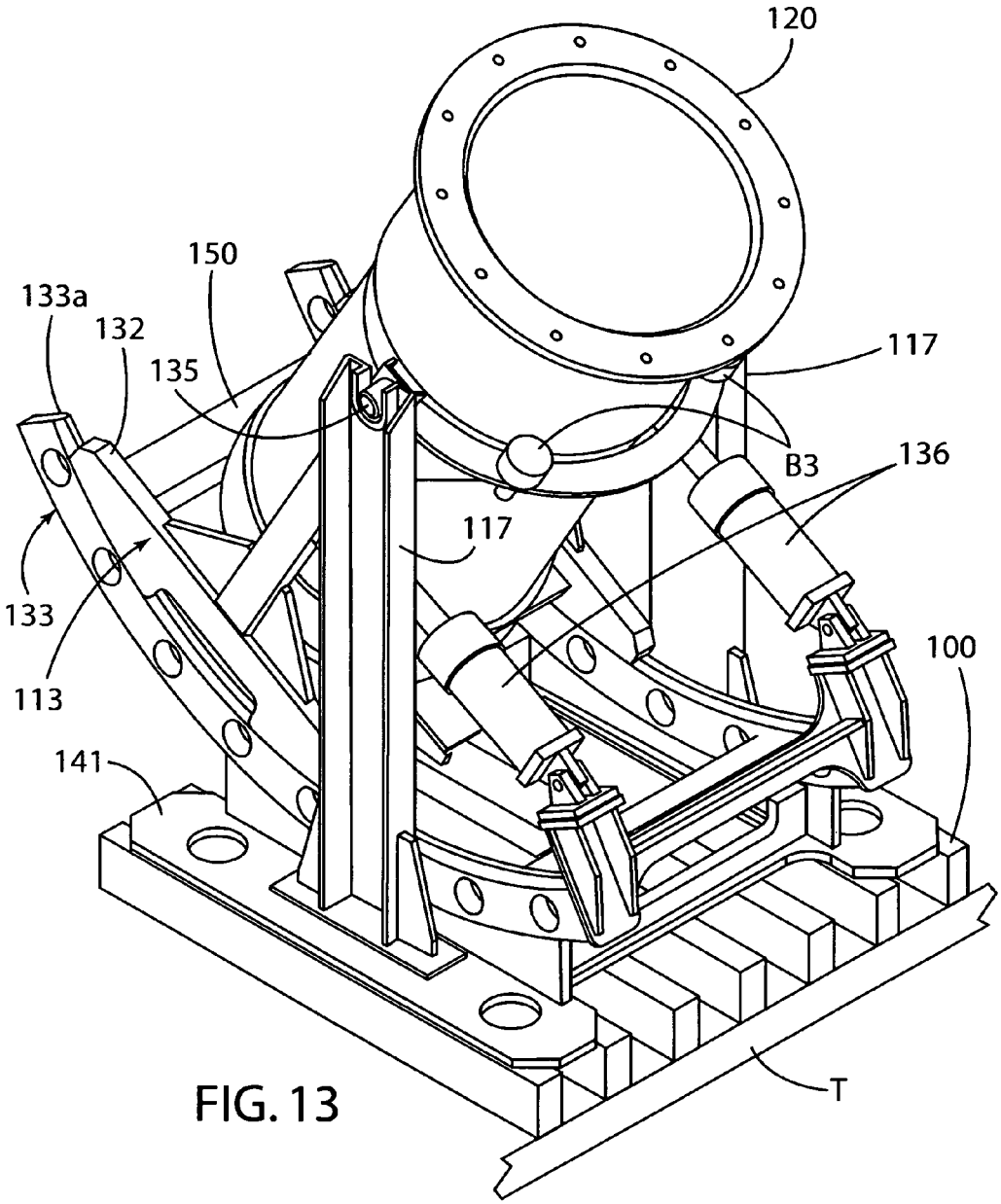
FIG. 13 is a perspective view of hydraulically operated compaction apparatus pursuant to still another embodiment of the invention for compacting support media around a ceramic shell mold or fugitive pattern.

FIG. 13 illustrates another apparatus embodiment of the invention for gravity or countergravity casting a mold or pattern. FIG. 13 shows a hydraulically operated compaction apparatus that is attached to the support deck 100 of a conventional compaction table (base) T. A flask 120 is supported in a rotatable nest (fixture) 150, which in turn is disposed on a tiltable nest support frame 113. The nest support frame 113 is tiltably (pivotally) supported on fixed trunnion posts or stanchions 117 by pivot pins 135 (one shown). The trunnion support stanchions 117 reside on a base pad 141 that is fixedly mounted on deck 100. The nest support frame 113 includes arcuate runners 132 that slide on arcuate rails 133*a* of a cradle 133 formed as part of or fixedly attached to the base pad 141. Vibration is transmitted from the table (base) T to the flask 120 through base pad 141 to rails 133*a* of a cradle 133 and then to the runners 132 of the nest support frame 113 on which the flask 120 is carried.

The cradle and runner arrangement also serves as a centering device about coaxial trunnion pivot pins 135 (one shown). The flask 120 is tilted in the manner described above about the pivot pins 135 by the action of hydraulic cylinders 136 connected at one end to the cradle 133 and at the other end to the outer side of the flask 120. The upper half of the flask rides on a pair of roller bearings B3 while the flask is rotated. The lower end of the flask 120 sits in the cylindrical rotatable nest 150 disposed on the nest support frame 113. The nest 150 is free to rotate on a combination radial/thrust bearing (hidden in this view). The nest 150 is rotated by a hydraulic motor through a friction drive by a pneumatic tire (also hidden in this view). The flask 120 receives a mold or pattern (not shown) of the type discussed above and particulates media (not shown) of the type discussed above for compaction about the mold or pattern.

Countergravity Casting

The apparatus of FIGS. 11A-11E can be used with any mold or pattern that needs compacted particulates media support during countergravity casting.

FIGS. 11A-11E illustrate a self-contained apparatus for compacting support particulates media 230 around a countergravity casting ceramic shell mold 210 in flask 220. This apparatus also can be used as well for compacting support particulates media about any kind of a gravity-poured mold or about any kind of lost foam pattern. Only the bottom of the flask 210 and the mold clamping arrangement would need to be different.

Figure 11A:
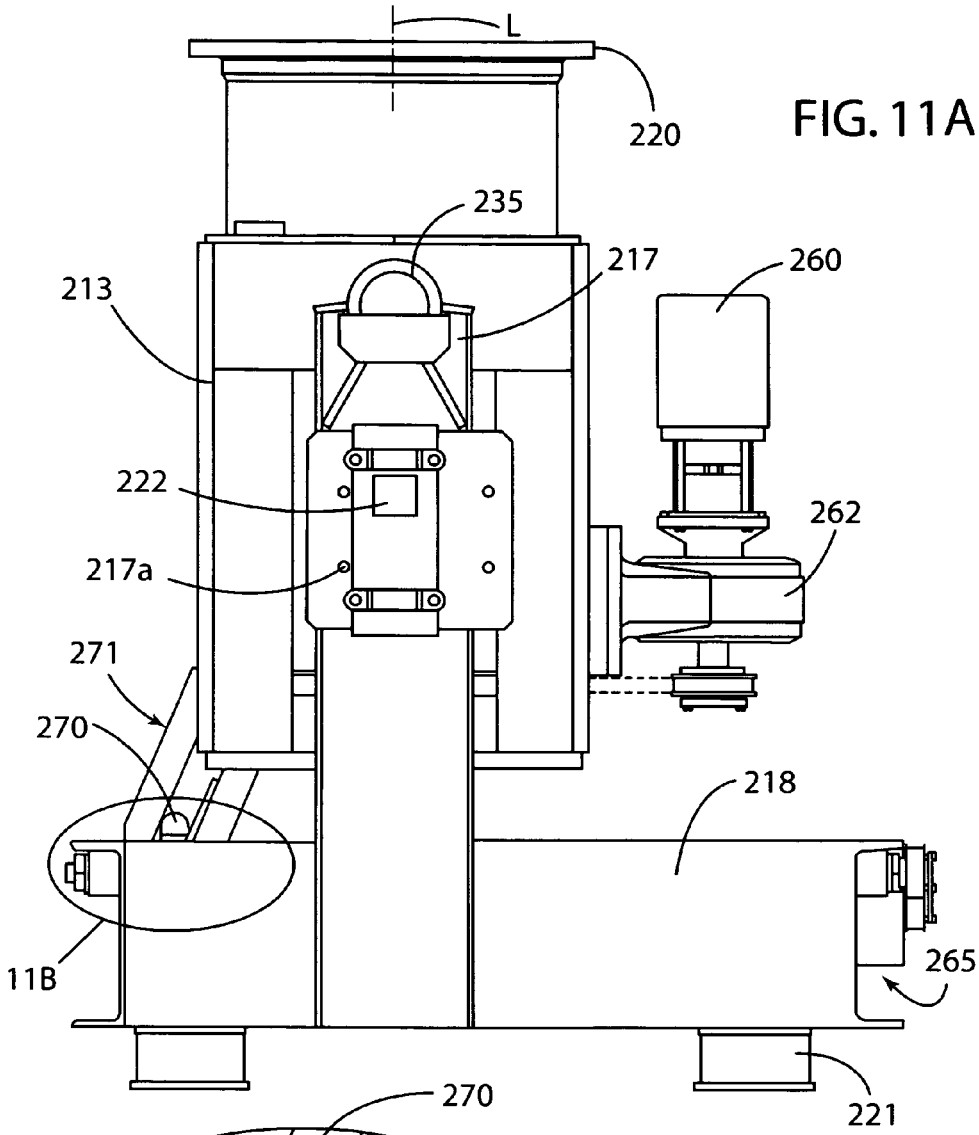
FIG. 11A is an elevational view of a self-contained apparatus pursuant to an embodiment of the invention for compacting support media around a counter-gravity casting ceramic shell mold before the container is tilted.
Figure 11B:
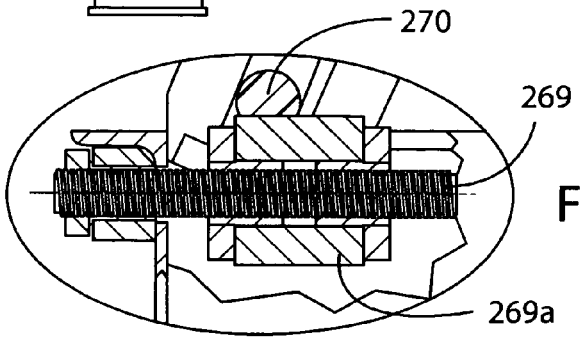
FIG. 11B is an enlarged sectional view of the encircled area of FIG. 11A.
Figure 11C:
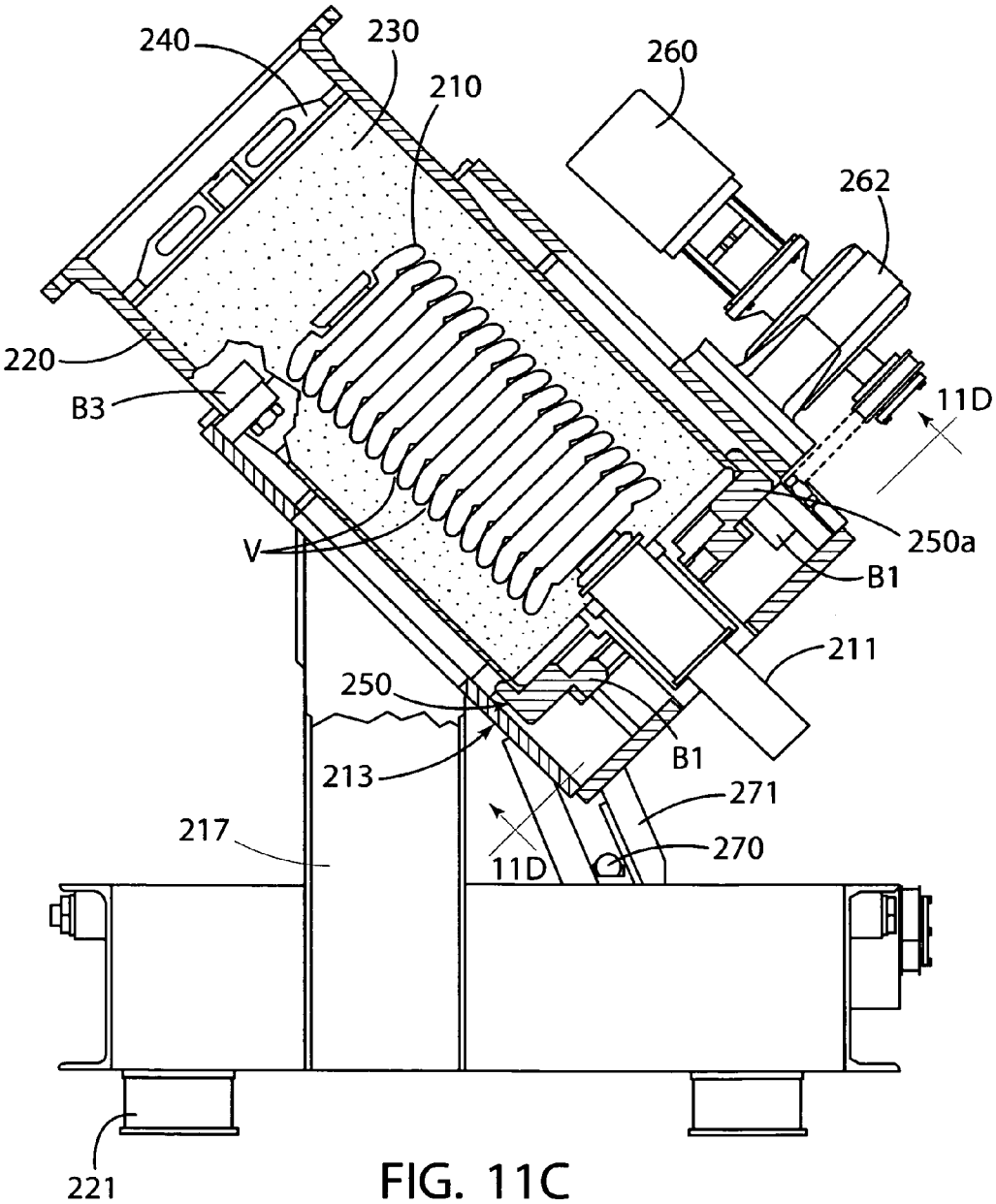
FIG. 11C is an elevational view of the self-contained apparatus of FIG. 11A, with certain components shown in cross-section for convenience, after the container is tilted to a selected angle of inclination.
Figure 11D:
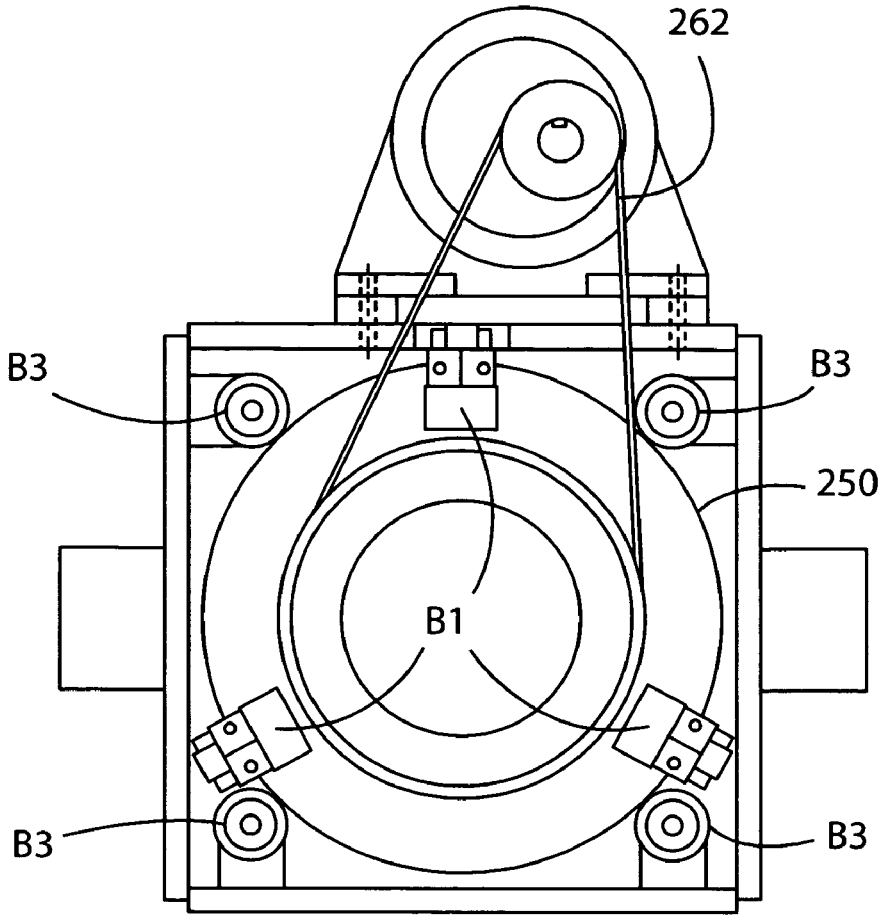
FIG. 11D is a view taken in the direction of arrows 11D of FIG. 11C.
Figure 11E:
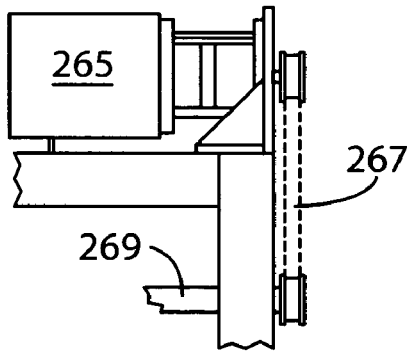
FIG. 11E is a partial elevational view of the drive motor for the ACME screw.

In FIG. 11C, a ceramic fill tube 211 is shown fastened to the shell mold 210, which is of the type described in U.S. Pat. No. 5,069,271 incorporated herein by reference and illustrated as ceramic shell mold 10 in FIG. 1. The mold 210 is placed into the casting flask 220 so that tube 211 protrudes from the bottom of the flask 210. The flask 210 is filled with support particulates media 230 and is covered with a lid 240 if the flask is to be tilted to the point where the particulates media 230 would spill from the flask. Flask 210 rests in a cylindrical nest (fixture) 250 comprising base plate 250*a* which is supported by three crowned roller bearings B1 supported on the bottom of tiltable frame 213.

Nest support frame 213 is supported by trunnions 235 resting in stanchions 217 of the main frame (base) 218. Each stanchion includes a plate 217*a* attached thereto for mounting electric vibrators 222 in a combination of orientations. The vibrators can be mounted with their axes vertical, for sideward vibration, or horizontal for up and down vibration. They can be mounted counter rotating for essentially linear vibration, or rotating in the same direction for a circular vibration pattern. Frequency and amplitude of vibration also can be adjusted. The compaction apparatus is supported on four pneumatic vibration isolators 221. In this arrangement the entire apparatus vibrates.

Rotation of the flask 220 is achieved by means of a gear motor 260 turning flask nest 250 by means of drive belt 262. Tilting of frame 213 is by means of another gear motor 265, drive belt 267, turning an acme screw 269, which in turn drives an ACME nut 269*a* attached to bar 270, which tilts the frame by acting on lever 271. Large amplitude vibration, greater than 1 G, causes unacceptable wear in the brass ACME nut. The tilted flask 220 is supported in rotation by two more roller bearings B3 that are disposed on the tiltable frame 213 and support the side of the flask.

For a countergravity casting embodiment of the invention, the method of inclined rotary compaction pursuant to the invention is similar to that descibed above for the gravity casting embodiment with the following exceptions:

The ceramic shell mold 210 is permanently assembled to the ceramic tube 211 through which the melt will be drawn into the mold.

The countergravity casting embodiment involves the following steps. The vertical flask 220, FIG. 11A, is filled with support particulates media 230, such as foundry sand, by any conventional means. To slightly shorten the compaction process, the flask 220 may be vibrated during the filling operation, but it is not necessary to do so at this time. (If vibration is not induced during the filling process, vibration isolators are not needed on the mold-loading fixture.)

If the flask is to be tilted past the point where media would spill over the rim a floating cover 240 is placed on the exposed surface to contain the media 230.

Vibration of the main frame 218 by vibrators 222 is started simultaneously with rotation of the flask about its vertical axis L and the flask is tilted continuously, incrementally, or at a fixed angle of inclination in the manner described above with respect to the gravity vector. For most molds or patterns having a multitude of cavities, a 30-35° maximum tilt angle is sufficient and a lid is not needed.

For any support particulates media being compacted with a combination of rotational speed, vibration frequency and vibration amplitude, a tilt angle can be found where the downward flow of the particulates media on the upper surface is exactly matched by the rate of rotation of the upper surface. As long as this tilt angle is not exceeded, the particulates media upper surface stays parallel to the rim of the flask and will be level when the flask is returned to vertical.

Flask rotational speed of between ½ to 2 rpm works best for most molds or patterns. Because of the tilt angle (angle of inclination) of the flask, horizontal voids that rotate to partially face upwardly readily fill under the combined influence of gravity and vibration. As the flask rotates, filled voids partially face downwardly during half of the cycle. However, they will not empty because their openings (e.g. OP) are now blocked by compacted particulates media.

The compacted particulates media around the mold or pattern prevents the mold or pattern from shifting in the flask; therefore the mold or pattern need not be supported during the compaction cycle.

Because the mold or pattern is not attached to a non-vibrating element, such as mold-loading fixture, but is free to float, mold or pattern distortion is minimized. Deep or contorted voids or large-volume voids with small openings may not completely fill during one rotation cycle. This, however, is not a problem. As the free surface in such void rotates past the dynamic angle of repose, particulates media flow is reestablished. Compacted media that has now rotated above the void, thus left, will fluidize and flow down into the void again. (see FIG. 10.) Conventional particulates compaction techniques will not do this.

Bridging of the particulates media granules or particles will randomly occur. If bridging occurs near the opening of a narrow internal void, or in the void, particulates media flow to the void may be temporarily blocked by dome-like secondary void formed in-situ at the opening or in the void. However, flask rotation will turn such a secondary dome-like void on its side, causing the dome-like void to collapse; reestablishing flow to the void.

Once a void is completely filled, gravity and vibration will consolidate the particulates media in the void while the void is sloped past the dynamic angle of repose of the particulate media. Since there are no free surfaces left in voids, no more particulates media fluidization will occur in or near the voids.

The compaction cycle is completed by returning the flask to the vertical orientation, FIG. 11A, and stopping the rotation and the vibration.

Of course, countergravity casting of molten metal or alloy upwardly through the riser passage and into the mold cavities of the shell mold 210 is conducted in a manner different from gravity casting and is described in detail in U.S. Pat. No. 5,069,271.

Figure 12B:
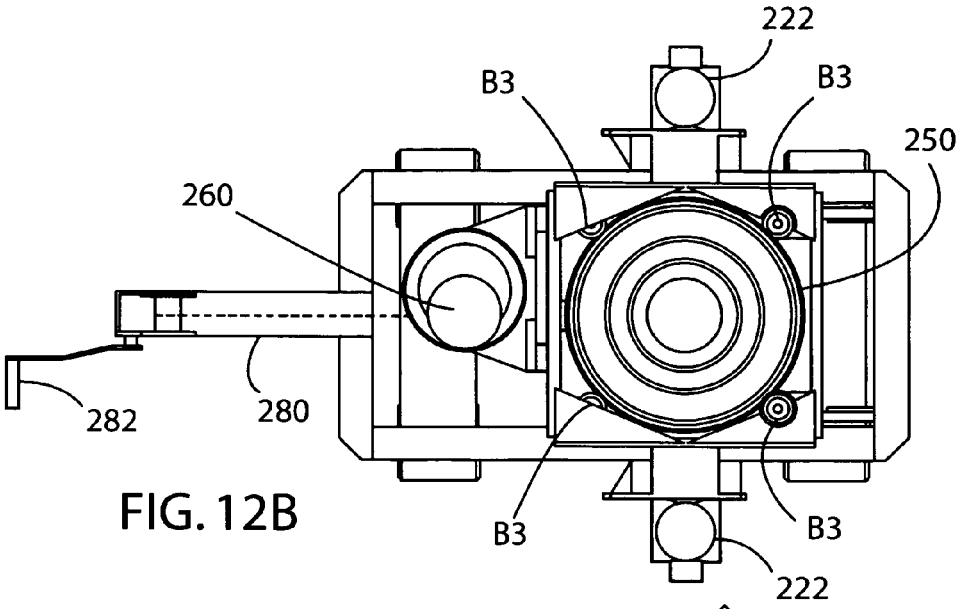
FIG. 12B is a plan view of the apparatus of FIG. 12A.
Figure 12A:
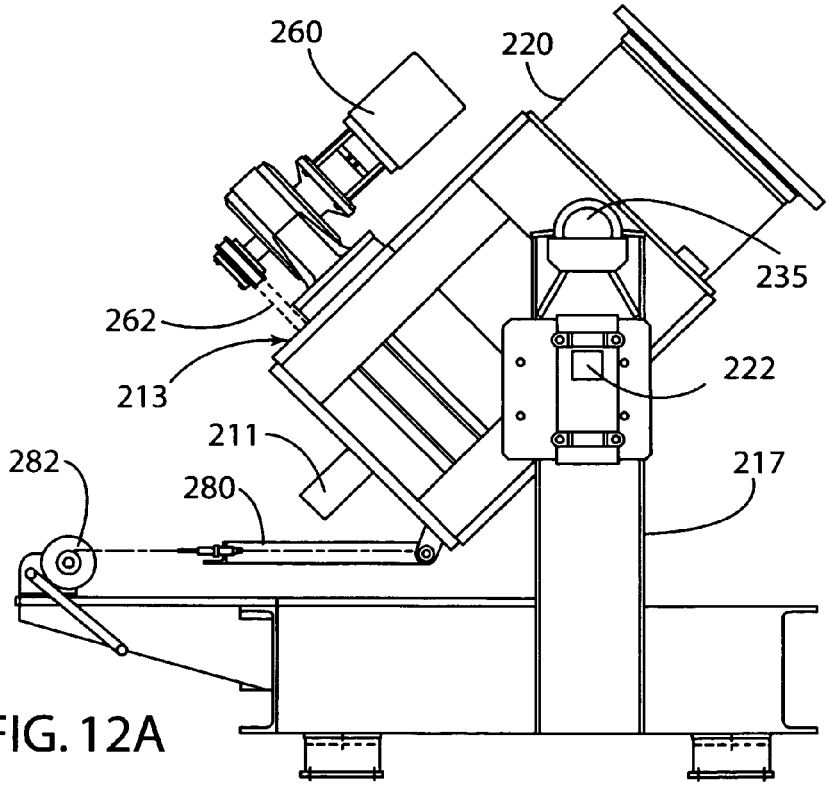
FIG. 12A is an elevational view of apparatus pursuant to another embodiment of the invention for compacting support media around a counter-gravity casting ceramic mold after the container is tilted using a harness pulled by a hand winch. This tilting arrangement is unaffected by vibration greater than 1 G.

FIGS. 12A, 12B depict a similar apparatus as that shown in FIGS. 11A, 11B and differing only in having a flask tilting mechanism that comprises a harness 280 pulled by a hand winch 282. An electric winch could be used just as well to pull the harness 280. This tilting arrangement is advantageous in that it is unaffected by vibration greater than 1 G. In FIGS. 12A, 12B, like reference numerals are used in connection with like features of FIGS. 11A, 11B.

Owing to the compaction efficiency of variable gravity and vibration vectors relative to the mold or pattern, vibration amplitude need not be as great as needed for conventional compaction techniques. For many compaction applications, vibration acceleration less than 1 G is sufficient. At amplitudes less than 1 G, the flask maintains contact with the support bearings, compaction noise is low and equipment wear is acceptable. The apparatus of FIGS. 11 through 13 will work well at these lower amplitudes.

Accelerometer measurements have shown that for an unrestrained flask, such as shown in FIGS. 11 through 13, vibration in one plane will induce vibration in all directions. Therefore, location and orientation of the vibrator(s) is relatively unimportant. It is preferable to attach the vibrators to stationary components of the compaction apparatus, because it's more convenient.

Figure 18:
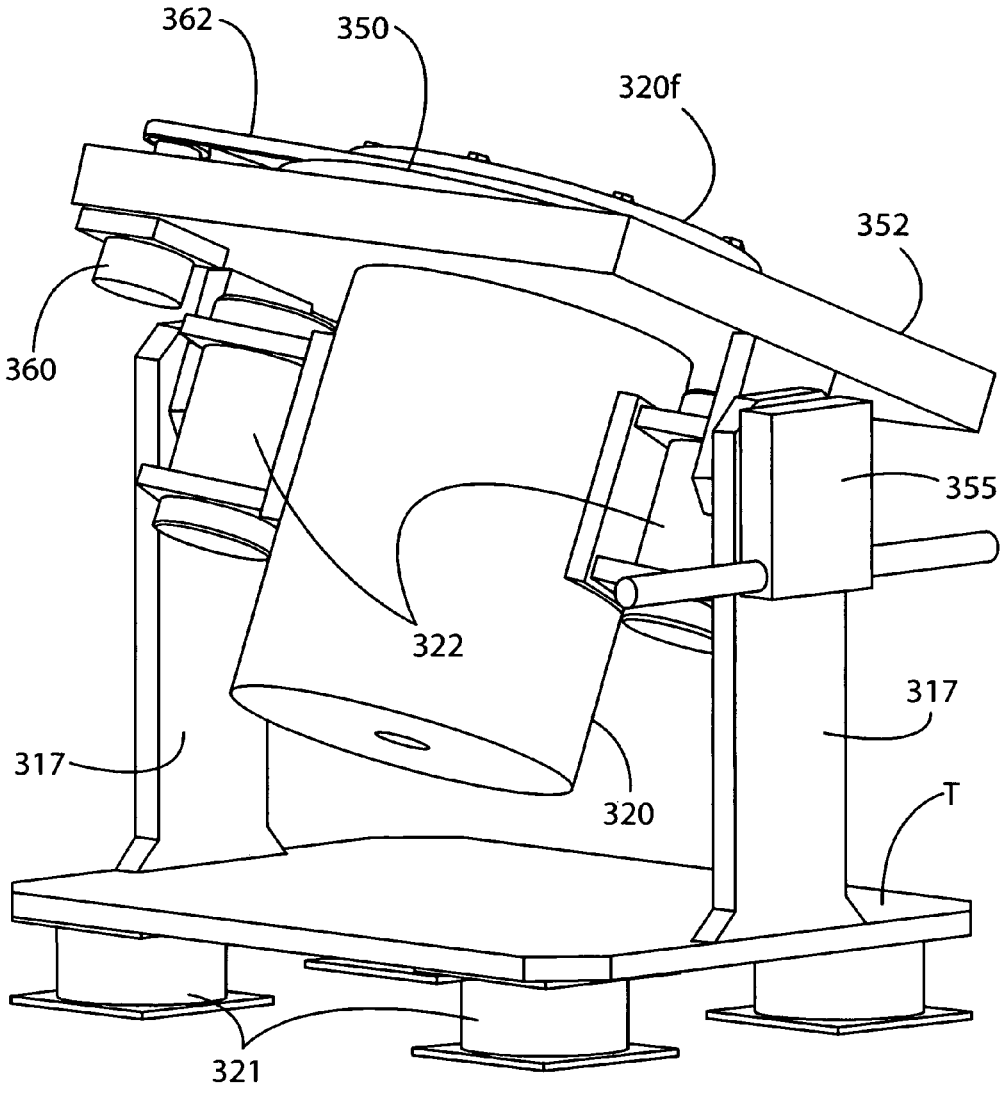
FIG. 18 is a perspective view of the apparatus of FIG. 14 showing vibrators mounted directly on the casting flask. The main structure of the apparatus is widened to accommodate the vibrators rotating with the flask.

Typically, during the entire compaction process, the flask needs to rotate less than a dozen times. Alternately, the flask can be rotated as little as 360°, and then rotated in the reverse direction for 360°. This rotational oscillation can be repeated as many times as needed. Each 360° rotational oscillation will have the same effect as two continuous revolutions in the same direction. Usually, 2 to 6 oscillations will achieve complete compaction. This technique make it easy to supply power to vibrators mounted directly on the flask as shown in FIG. 18 where vibrators 322 are shown disposed directly on the flask 320. The advantage of this embodiment is that more vibration energy is transmitted to the particulate media (not shown) in the flask 320. The flange 320*f* of the casting flask 320 is bolted, clamped or otherwise supported on a hub or nest (fixture) 350, which is retained on tiltable platform frame 352 with impact resistant synthetic plates being used as bearing surfaces between the flange, the hub or nest 350 and the platform frame 352 as described below in connection with FIGS. 14-15. The hub or nest 350 is rotated by drive belt 362, driven by hydraulic motor 360. Tilting of the platform frame 352 up to 180° is accomplished via hydraulic actuator 355 disposed on stanchions 317, which are mounted on a table T. The table is mounted on four pneumatic vibration isolators 321. The flask can be sealed by a lid (not shown but described in connection with FIGS. 14-15). The spread of the stanchions 317 is widened to accommodate the vibrators rotating with the flask. The advantage of this variation is that more vibration energy is transmitted to the media in the flask.

If vibration amplitude greater than 1 G is needed and low noise level is desired, the casting flask needs to be secured to the rotating and vibrating components of the compaction apparatus. Such an embodiment is depicted in FIGS. 14 through 18 where the flange 320*f* of casting flask 320 is bolted or clamped to a hub or nest 350, which is retained between flange 351 and platform frame 352. The hub or nest 350 rotates on synthetic bearing surfaces 349, FIG. 15. This assembly is captured between retaining flange 351 and platform 352. The hub 350 is rotated through drive belt 362 driven by hydraulic motor 360. Tilting of the platform 352 up to 180° is accomplished via hydraulic actuator 355 disposed on stanchions 317, which are mounted on a table T. The table is mounted on four pneumatic vibration isolators 321.

Figure 16:
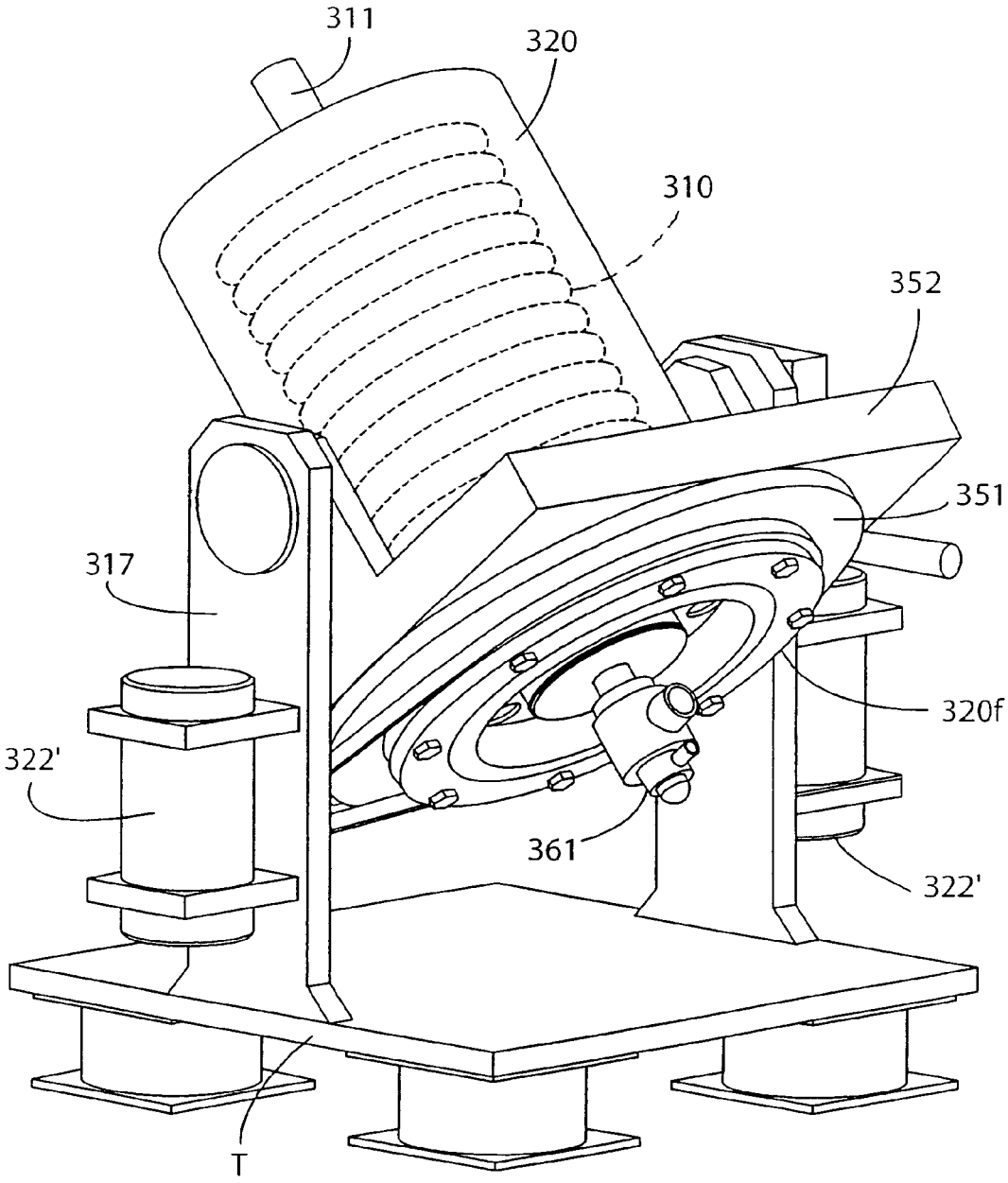
FIG. 16 is a perspective view of the apparatus of FIG. 14 showing the flask tilted past horizontal.
Figure 17:
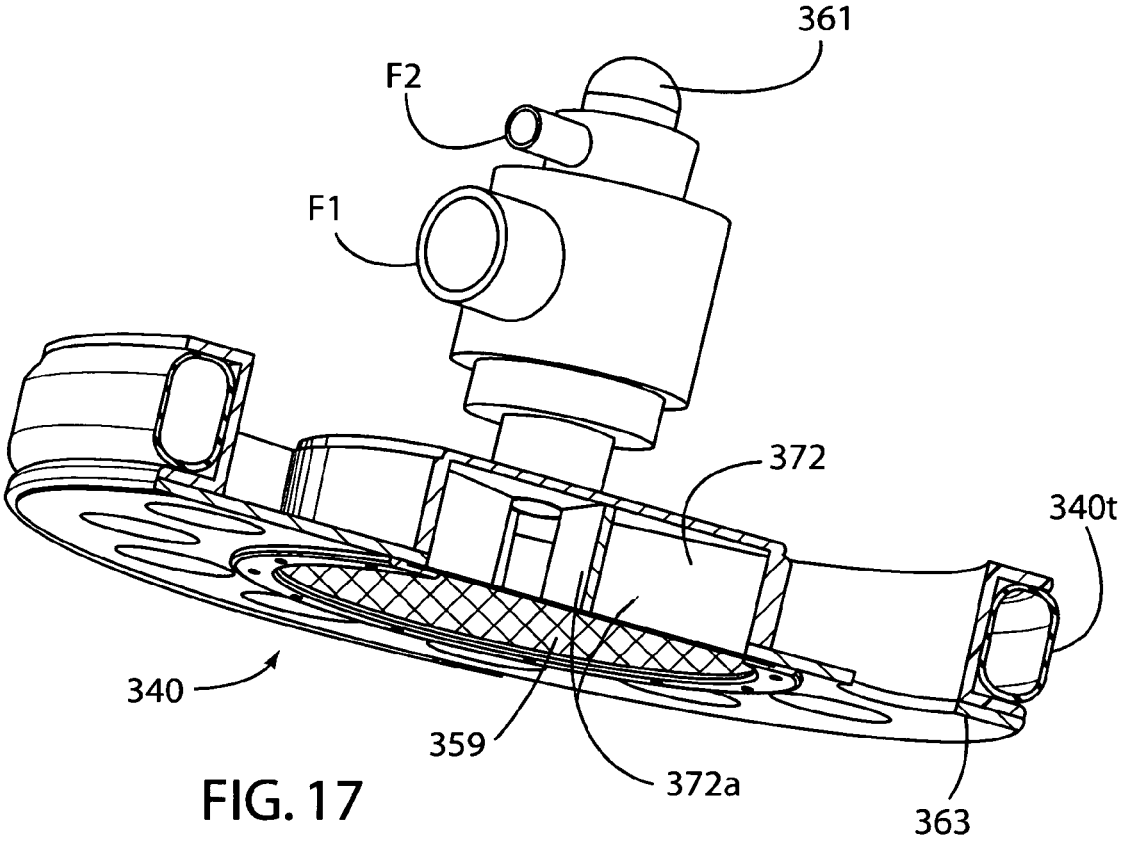
FIG. 17 is a partial perspective view, partially in cross section, showing components of the flask lid of FIGS. 14 and 16.

The flask 320 is sealed by a lid 340 that rests on top of the support media 330. The lid includes an inflatable rim seal tube 340*t* and a rotary union 361 connected to a vacuum source, such as vacuum pump (not shown). The inflatable rim seal tube 340*t* provides an airtight seal against the wall of flask 320. The lid 340 includes a screen 359 through which air can pass but not the particulates media 330, thereby allowing for the partial evacuation of the flask through plenum 372 disposed on the lid 340. The plenum 372 communicates via a fitting F1 of rotary union 361 to a vacuum pump and via fitting F2 to an air pump to inflate seal 340*t*, FIG. 17, which can be a commercially available rotary union. The plenum 372 includes radial fins 372*a* to provide reinforcement for screen 359. Atmospheric air pressure causes elastic membrane 363 of the lid 340 to bulge and to conform to top of the particulates media in the flask. The flask can be evacuated to partial vacuum (e.g. 3-4 psi vacuum) through rotary union 361 and plenum 372. The pressure differential thus established across the lid 340 is used to retain the mold or pattern and the particulates media in the flask when the flask is upended or inverted past horizontal as shown in FIG. 16. The lid 340 with inflatable rim seal tube 340*t* is retained by atmospheric pressure acting against the partially evacuated flask 320.

Figure 14:
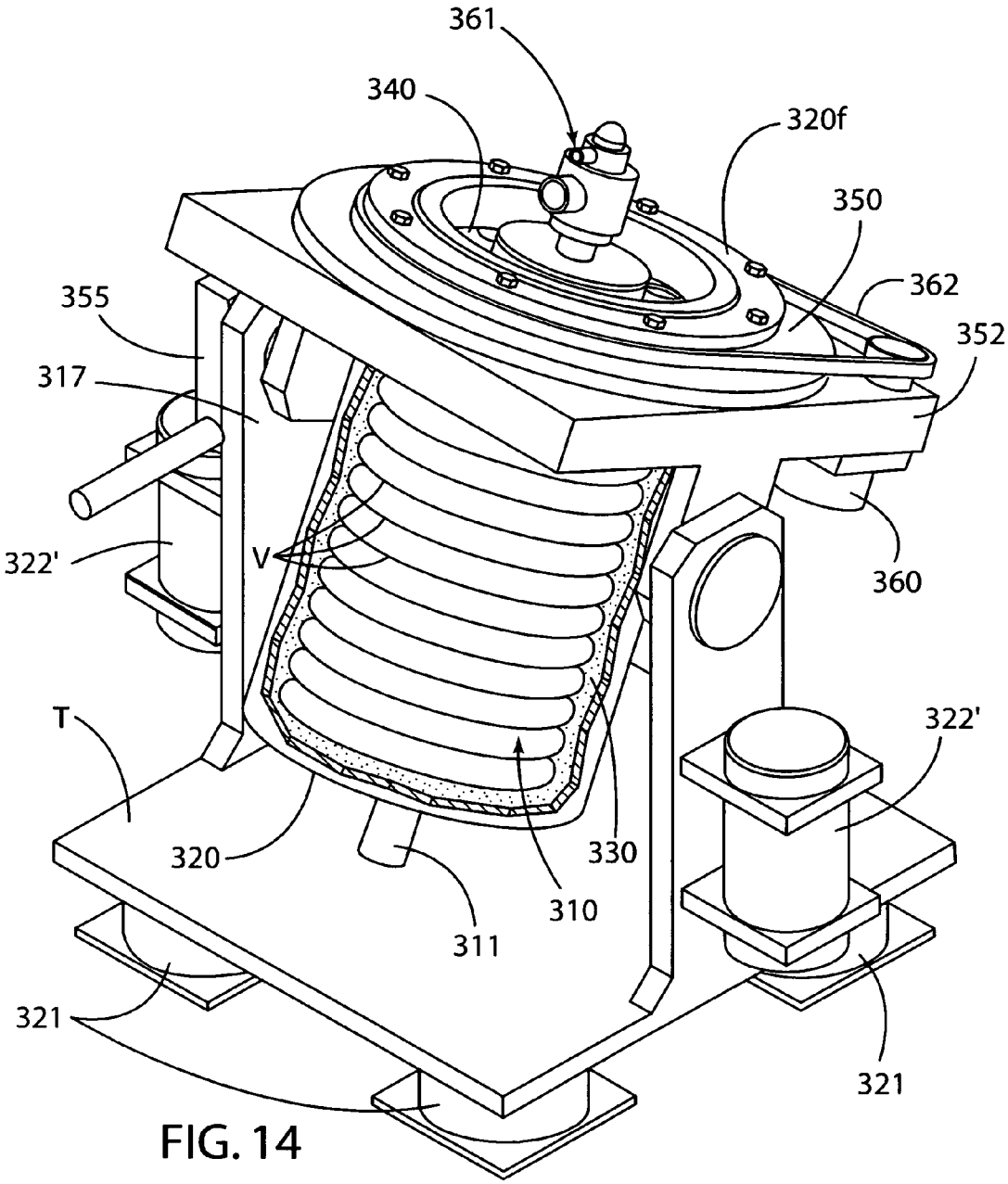
FIG. 14 is an isometric view of another hydraulically operated compaction apparatus pursuant to still a further embodiment of the invention for compacting support media around a ceramic shell mold or fugitive pattern.

Vibration of the flask 320 during compaction is provided by two electric vibrators 322' and/or vibrators 322 of the type shown in FIGS. 14 and 16, mounted on the stachions, or in FIG. 18 mounted directly on the flask 320. The apparatus is mounted on four pneumatic vibration isolators 321, which support the table T.

During compaction about the mold 310, the upper surface of the particulates media 330 drops as the particulates media is compacted into the voids V at the mold 310 (or pattern) in the flask. The lid 340 continues to engage the upper surface of the particulates media as it recedes into the flask, regardless of flask orientation, by virtue of the pressure differential between the outside ambient air pressure and the partial vacuum in the flask 320. Air tight, moveable sealing between the lid 340 and adjacent wall of the flask 320 is maintained by inflatable rim seal tube 340*t*.

Figure 15:
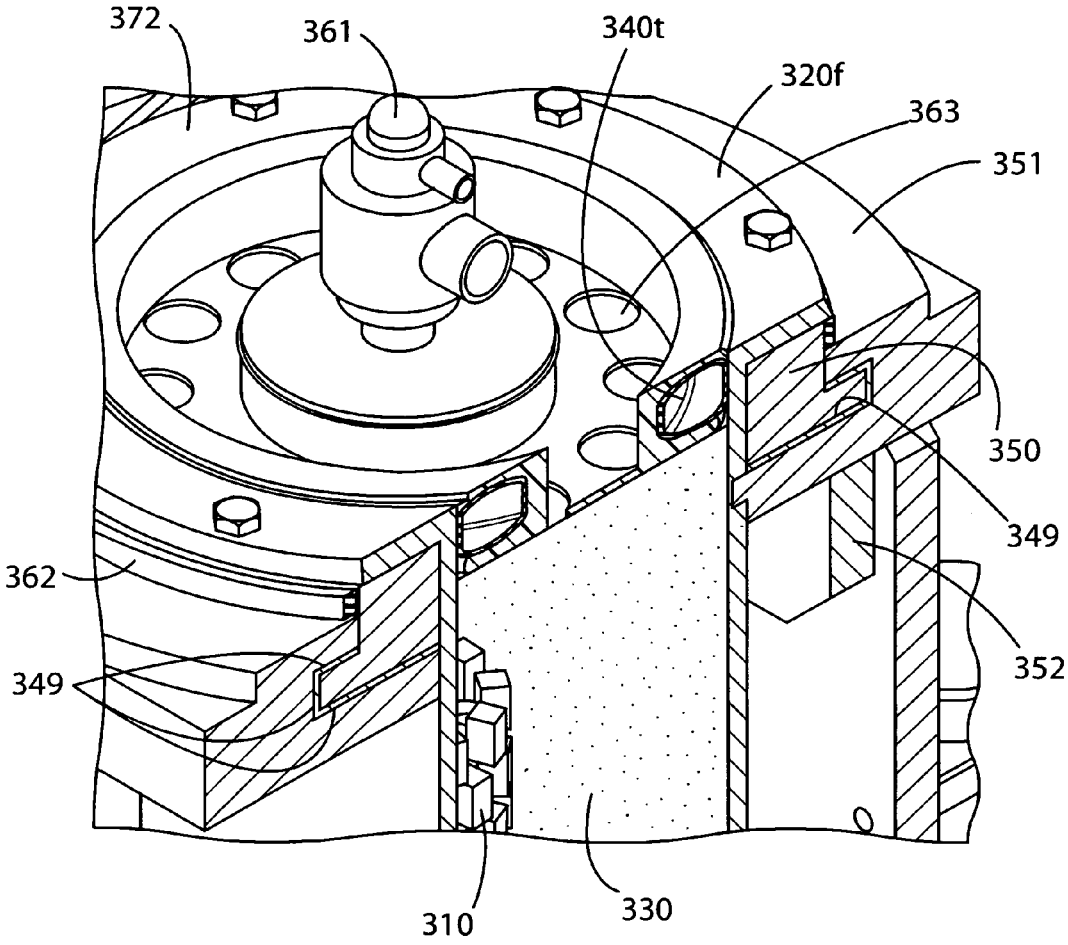
FIG. 15 is an enlarged cross-section of the floating multi-function lid of FIG. 14.

The apparatus of FIGS. 14-18 for use with vibration amplitude greater than 1 G differs from the other apparatus embodiments by replacing ball roller bearings with radial and thrust bearings 349 fabricated from impact resistant, low friction plastic as illustrated in FIG. 15. Alternately two large-diameter angular-contact, ball bearings (not shown) could be used, with the rotating nest captured between them. Regardless, there are no loose components to bounce free, so noise and impact forces are controlled in FIGS. 14-18.

As mentioned, the casting flask 320 is bolted, clamped or otherwise fastened to the rotating hub or nest 350 that is sandwiched between components of a tilting platform. Because the rotating hub or nest 350, along with the flask 320 secured to it, are confined to the extent that they can only rotate and tilt, the vibration transmitted to the flask preserves its directional nature to a greater extent and secondary vibration out of the plane of the vibration vector is diminished. This has the desirable effect of simultaneously changing both the gravity and the vibration vectors relative to the mold or pattern in the flask in a smooth, continuous, methodic manner. A hydraulic motor provides rotation to the nest 350, while a hydraulic actuator tilts the platform 352 up to 180 degrees continuously, incrementally or to a fixed angle of inclination.

The flask contains ceramic shell mold 310 having fill tube 311. The flask includes a lid 340 that has inflatable tube seal 340*t* along its periphery and that has a rotary union 361 for seal inflation and for the partial evacuation of the flask. Alternately, an inner tube-type check valve (not shown) can be used on the inflatable tube seal 340*t* such that the air passage in the rotary union for the seal 340*t* can be eliminated. The lid has a flexible membrane exposed to ambient air on one side and to the flask interior on the other side. Once the flask 320 is fitted with the mold or pattern, filled with loose particulates media 330, covered by the lid 340, the seal 340*t* is inflated and the flask 320 is evacuated to 3-4 psi vacuum.

At this point the casting flask 320 can be completely upended. Atmospheric pressure will support the lid 340, and the contents of the flask regardless of its orientation.

During compaction of the particulates media 330 in the apparatus of FIGS. 14-18, the particulates media flows into voids at the mold or pattern and is compacted. A "bubble" comprising rarified media will develop and travel toward the high point of the flask 320. If the flask is tilted past horizontal the high point will be at the bottom corner of the flask. As it floats up, the "bubble" will spread at the angle of repose and accumulate under any impermeable obstruction encountered during the upward passage. With an upended flask an air gap will form at the bottom of the flask. As the rotating flask is tilted back toward vertical, the air gap will spiral along the flask wall to the top of the flask where it is accommodated by the lid 340 settling into the flask to take up some of this space and the rest of the space being filled by the flexible membrane 363 as it is bulged into the flask by atmospheric pressure. The displaced air in the flask exits through the screen 359 on the bottom center of the lid 340. Pressure from the lid 340 and the flexible membrane 363 further compacts the top layer of the media. When the flask is upended again, the pressure maintains compaction. Through repeated cycling of partially evacuated flask inclination, simultaneous with methodic flask rotation and vibration, all voids and rarified media volumes are channeled along the flask wall and eliminated through the screen 359 in the lid 340.

In practicing this more complex inclined rotary compaction method embodiment of the invention, it is preferred to have the rotational cycle frequency be an even multiple of the tilting cycle frequency. For example, if the flask is rotated at a steady 2 rpm, then the flask is smoothly and continuously cycled through a tilt angle from 0 to 180° and then back to 0° in one minute. This cycle is repeated until full compaction is achieved. Such parameters will result in equal opportunity for all voids at the mold or pattern to be filled regardless of orientation. The apparatus described in FIGS. 14 through 18 will completely fill all voids shown in FIGS. 1 through 5 with compacted particulates media.

This embodiment of the invention can be practiced for compacting particulate media around gravity casting molds also. Regardless of flask geometry, a lid can be fabricated with a seal and flexible membrane as described previously above. The pour cup on the casting mold is temporarily sealed and the entire casting mold, including the pour cup is covered in support media. The lid is fitted to the chamber, the lid seal is inflated and the flask is evacuated to 3-4 psi below ambient pressure. The flask can now be completely upended during the compaction process. The low pressure differential across the lid is sufficient to retain the contents of the flask. After compaction is complete, the flask is returned to vertical, the lid is removed, and sufficient media is removed to expose the pour cup for casting.

Practice of the inclined rotary compaction process has several advantages including, but not limited to, remote void recesses and horizontal overhangs at molds or patterns are efficiently filled with compacted media, any free particulates media surface buried deep under compacted support particulates media will start filling the voids again during at least ¼ of each flask rotation cycle, and bridging by the media particles or grains is efficiently eliminated by methodic tilting of the above-described bridged dome-like secondary voids that can result from bridging onto their sides and tops so that the dome-like secondary voids are either collapsed, or are filled. Moreover, because the mold or pattern does not need to be supported and the gravity vector is continuously and smoothly varied relative to the mold or pattern during compaction, distortion of the mold or pattern is minimized. The feeding rate of the particulates media to the flask does not have to be varied as in existing lost foam compaction systems. The flask can be quickly filled and compacted afterward. The vibration vector of the compaction table does not have to be varied. Instead the mold or pattern orientation is methodically varied relative to the vibration and gravity vectors. The compaction method is part independent, and no special compaction recipes are required for different molds or patterns.

Although the invention has been described with respect to certain embodiments, those skilled in the art will appreciate that changes, modifications and the like can be made thereto without departing from the spirit and scope of the invention as set forth in the appended claims.

We claim:

1. A method of compacting particulates media about a mold or pattern, comprising disposing a mold or pattern in a particulates media in a container and subjecting the container to a combination of vibrating, rotating, and tilting in a manner that the particulates media are induced to fill voids at a mold or pattern wall, wherein the combination of rotation and tilting causes voids formed by an outside wall of the mold or pattern to be continuously or repeatedly reoriented so that a free surface of the particulates media in the voids is moved past its dynamic angle of repose, whereby the particulates media is caused to flow into those voids by the combined action of the vibration and a constantly changing orientation of the voids relative to a gravity vector.

2. The method of claim 1 including rotating the container about a first axis and tilting the container about a second axis.

3. The method of claim 2 wherein the container is rotated about its longitudinal axis.

4. The method of claim 2 wherein the second axis is perpendicular to the first axis.

5. The method of claim 1 including continuously vibrating, continuously rotating, and continuously tilting the container to vary mold or pattern orientation relative to a gravity vector.

6. The method of claim 5 wherein rotation includes oscillating one or more times between one revolution in a first direction followed by rotation in the opposite reverse direction.

7. The method of claim 1 including tilting the container in angular increments of inclination during compaction of the particulates media.

8. The method of claim 7 wherein the container is subjected to rotation and vibration at each of the angular increments of inclination.

9. The method of claim 1 including subjecting the container to rotation and vibration while the container is tilted at a fixed angle of inclination.

10. The method of claim 1 wherein the combination of rotation and tilting positions openings to the voids to face downward.

11. The method of claim 10 wherein consolidated particulates media in the flask blocks the downwardly facing openings to prevent particulates media in the voids from exiting therefrom.

12. The method of claim 1 wherein the combination of rotation and tilting repositions openings to the voids to face upwardly again so that the particulates media flows into those voids again.

13. The method of claim 1 wherein once the voids are completely filled with particulates media, consolidation of the particulates media is achieved by the combined action of vibration and gravity while openings to the voids are upward facing and the voids slope downwardly.

14. The method of claim 1 including a final step of returning the container to a vertical orientation after compaction of the particulates media.

15. The method of claim 14 including leveling the particulates media after the flask is returned to the vertical orientation by vibration or manual leveling.

16. The method of claim 1 including placing a lid, comprising a material denser than the bulk density of the particulates media, on the free surface of the particulates media in the flask.

17. The method of claim 16 wherein an unrestrained lid prevents the particulates media from spilling from the flask when the flask is tilted past the angle of repose of the particulates media.

18. The method of claim 17 including tilting the container up to 50 degrees relative to its initial vertical position.

19. The method of claim 16 including at least partially sealing the lid relative to the flask so that a subambient pressure is established in the container.

20. The method of claim 19 including moving the lid by means of pressure differential across the lid in a manner to remain engaged with an upper surface of the particulates media as it recedes during compaction regardless of container orientation.

21. The method of claim 20 wherein part or all of the lid comprises a flexible membrane kept in intimate contact with the media surface by a differential pressure across the membrane.

22. The method of claim 19 wherein the lid communicates to a source of vacuum through a rotary union, permitting the lid to rotate with the container.

23. The method of claim 19 including subjecting the container to continuous rotation and vibration while it is continuously tilted back and forth up to 180 degrees between a vertical, upright orientation and an inverted orientation.

24. The method of claim 1 including temporarily covering a pour cup of a gravity casting mold in the container with particulates media before compaction and then removing sufficient particulates media to uncover the pour cup after compaction.

25. The method of claim 1 wherein a counter-gravity invested mold having a protruding fill tube is placed in the container with the fill tube protruding outside the container.

26. The method of claim 25 including clamping the fill tube while the flask is filled with the particulates media until the mold is covered by the particulates media.

27. The method of claim 26 wherein after compaction of the particulates media, a casting lid is placed on top of the media and worked into the surface to eliminate possible voids on the surface.

28. The method of claim 1 wherein the particulates media is compacted about a ceramic shell mold.

29. The method of claim 1 wherein the particulates media is compacted about a refractory fugitive pattern.

30. The method of claim 1 wherein the container with the mold or pattern is filled with particulate media while the container is subjected to a combination of vibration, tilting, and rotation.

31. The method of claim 1 wherein the container with the mold or pattern is partially or completely filled with particulate media before the container is subjected to a combination of vibration, tilting, and rotation.

* * * * *